US007401651B2

(12) United States Patent
Shkurti

(10) Patent No.: US 7,401,651 B2
(45) Date of Patent: Jul. 22, 2008

(54) WELLBORE FLUID SAVER ASSEMBLY

(75) Inventor: Piro Shkurti, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 247 days.

(21) Appl. No.: 11/235,902

(22) Filed: Sep. 27, 2005

(65) Prior Publication Data

US 2007/0068676 A1 Mar. 29, 2007

(51) Int. Cl.
*E21B 43/26* (2006.01)

(52) U.S. Cl. ..... 166/308.1; 166/387; 166/191

(58) Field of Classification Search ..... 166/308.1, 166/387, 186, 191
See application file for complete search history.

(56) References Cited

U.S. PATENT DOCUMENTS

| | | | | |
|---|---|---|---|---|
| 6,655,461 | B2 * | 12/2003 | Eslinger et al. | 166/305.1 |
| 6,883,610 | B2 * | 4/2005 | Depiak | 166/308.1 |
| 6,907,936 | B2 * | 6/2005 | Fehr et al. | 166/387 |
| 7,134,505 | B2 * | 11/2006 | Fehr et al. | 166/387 |
| 2002/0117301 | A1 * | 8/2002 | Womble | 166/278 |

OTHER PUBLICATIONS

Strickler, Michael P. et al.; FASTFrac™ CT Fracturing System Allows Multiple Isolation of Long Zones in One Trip; Baker Hughes inDepth Online Magazine, vol. 11, No. 2, 2005, pp. 34-43 (11 pgs.).

Thru-tubing Intervention What's New—Baker Oil Tools introduces innovative FASTFrac™ Systems to selectively stimulate multiple intervals in single coiled tubing run; Jun. 17, 2004 (2 pgs.) available at http://www.bakerhughes.com/bot/thru_tubing/news_press_fastfrac.htm.

FASTFrac Interval Isolation Systems—Multiple Stimulations in a Single Trip; Sep. 9, 2004 (3 pgs.) available at http://www.bakerhughes.com/bakerhughes/inDepth/10.no1.2004/upfront_bot.pdf.

Wellbore Intervention—Guide to Successful Coalbed Methane Completion and Stimulation; Jan. 13, 2005 (4 pgs.) available at http://www.bakerhughes.com/bot/service_tools/pdf/coalbed_methane.pdf.

* cited by examiner

*Primary Examiner*—William P. Neuder
(74) *Attorney, Agent, or Firm*—Conley Rose, P.C.

(57) ABSTRACT

A method for performing a service operation within a wellbore extending into a formation comprises sealing a first length of the wellbore to define a first isolated formation zone, flowing a pressurized fluid through a tubular string into the first isolated formation zone, and unsealing the first length of the wellbore without venting the pressurized fluid from the tubular string or awaiting depressurization of the first isolated formation zone.

An assembly connected to a tubular string for performing a service operation in a wellbore comprises a mandrel with a flowbore in fluid communication with the tubular string, an upper sealing device, a lower sealing device, a selectively operable valve that enables or prevents fluid communication between the flowbore and the wellbore, and a selectively closeable bypass flow path.

27 Claims, 25 Drawing Sheets

WELLBORE FLUID SAVER ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to wellbore straddle-packer assemblies and methods of wellbore servicing with a pressurized fluid. More particularly, the present invention relates to a wellbore straddle-packer comprising a fluid saver assembly which, upon completion of the service operation, can be moved without venting pressurized fluid to the surface or waiting for the pressurized formation to bleed down.

BACKGROUND

As conventional sources of natural gas in North America decline while demand for this energy resource continues to grow, coal bed methane (CBM) has been identified as a viable alternative energy source. CBM is aggressively being extracted from multi-zone wellbore formations, and during production of these formations, downhole tools are used to deliver pressurized fluid to stimulate CBM production. In particular, the tool is set within the wellbore to isolate a formation zone, and pressurized nitrogen, or another type of fracturing fluid, is pumped through the tool into the isolated formation zone. The pressurized fluid acts to open or expand "cleats" within the coal seam, thus forming a communication channel through which the CBM can flow into the cased wellbore and then up to the surface.

Fracturing multi-zone CBM wellbore formations is often performed using downhole cup-style straddle-packers. Typically, pressurized nitrogen is pumped through a work string, such as coiled tubing, once these cup-style straddle-packers are set at a particular location within the wellbore. After fracturing a zone, it may be necessary to allow the pressurized formation to bleed down from the applied treatment pressure in order to unseat the cups and allow movement of the straddle-packer to the next zone to be fractured. The time required for this bleed down to occur may be 20 minutes, for example. Because many CBM wellbores have multiple zones to fracture, such as 15 to 20 zones, the total time waiting for formation bleed down to occur can be significant and increases the cost of fracturing the wellbore. As an alternative to waiting for the formation to bleed down, the pressurized fluid contained in the work string may be vented to the surface. This, however, wastes volumes of pressurized fluid that could otherwise be usefully injected into the CBM formations, thereby also increasing the cost of fracturing.

Besides the costs associated with venting pressurized fluid, and the time delays associated with waiting to move conventional straddle-packers, the cup-style sealing elements also have operational limits. As the demand for natural gas continues to rise, it has become necessary to drill deeper wellbores, and therefore, fracture formation zones at greater depths. As wellbore depths increase, cup-style sealing elements reach their operational pressure limits and no longer work reliably. Furthermore, the rubber material of the cups is incompatible with acids and other chemicals that may be contained in some wellbore servicing fluids. Even assuming the rubber cups are suitable for use operationally, venting of a pressurized fluid containing acids or chemicals to the surface may be prohibited due to environmental regulations. Where no such prohibition exists, repeated venting of a pressurized fluid containing acid or chemicals is still undesirable, as such venting can be expensive.

Therefore, due to the time and the increased operational cost associated with moving and re-seating typical cup-style straddle-packers during fracturing of multi-zone CBM well formations, the costs associated with venting pressurized fluid to the surface, the inability of cup-style sealing elements to function reliably at greater wellbore depths, and the incompatibility of rubber cups with acids and other chemicals, a need exists for a downhole tool designed for such operations. Specifically, a need exists for a straddle-packer assembly that reduces the time between fracturing multiple zones, does not require venting of pressurized fluid to the surface, is operational at greater wellbore depths, and is compatible with fluids containing acids and other chemicals.

SUMMARY OF THE INVENTION

In one aspect, the present disclosure relates to a method for performing a service operation within a wellbore extending into a formation comprising: sealing a first length of the wellbore to define a first isolated formation zone, flowing a pressurized fluid through a tubular string into the first isolated formation zone, and unsealing the first length of the wellbore without venting the pressurized fluid from the tubular string or awaiting depressurization of the first isolated formation zone. The method may further comprise: containing the pressurized fluid within the tubular string, moving the tubular string within the wellbore, sealing a second length of the wellbore to define a second isolated formation zone, flowing a pressurized fluid through the tubular string into the second isolated formation zone, and/or equalizing pressure between the sealed first length and an unsealed portion of the wellbore. In an embodiment, the method is performed in a single trip into the wellbore. The service operation may comprise fracturing a coal bed methane formation, and the pressurized fluid may comprise nitrogen, water, acid, chemicals, or a combination thereof.

In another aspect, the present disclosure relates to a method for performing a service operation within a wellbore extending into a formation comprising: running an assembly comprising a valve into the wellbore on a tubular string, fixing the assembly within the wellbore to define a first isolated formation zone, flowing a pressurized fluid through the valve into the first isolated formation zone, and closing the valve to contain the pressurized fluid within the tubular string. The method may further comprise: moving the assembly without venting the pressurized fluid from the tubular string or awaiting depressurization of the first isolated formation zone, equalizing pressure across the assembly before moving the assembly, re-fixing the assembly within the wellbore to define a second isolated formation zone, opening the valve, and/or flowing the pressurized fluid through the valve into the second isolated formation zone. In an embodiment, fixing the assembly comprises activating an upper seal and a lower seal within the wellbore to straddle the first isolated formation zone. In another embodiment, fixing the assembly further comprises activating an upper anchor and a lower anchor within the wellbore to straddle the first isolated formation zone. The method may further comprise bypassing pressure around the upper anchor when running the assembly into the wellbore.

In yet another aspect, the present disclosure relates to a method for performing a service operation within a wellbore extending into a formation comprising: running an assembly into the wellbore on a tubular string, engaging a wellbore wall with the assembly, setting down on the tubular string to activate upper and lower seals of the assembly against the wellbore wall to define an isolated formation zone, additional setting down on the tubular string to open a valve of the assembly, flowing a pressurized fluid through the valve into the isolated formation zone, and picking up on the tubular string to close the valve and contain the pressurized fluid within the tubular string. The method may further comprise additional picking up on the tubular string to move the assembly without venting the pressurized fluid from the tubular string or awaiting depressurization of the isolated formation zone. In various embodiments, the additional picking up opens a bypass flow path, the setting down on the tubular string activates a lower anchor of the assembly against the wellbore wall, and/or the additional setting down on the tubular string activates an upper anchor of the assembly against the wellbore wall.

In still another aspect, the present disclosure relates to an assembly connected to a tubular string for performing a service operation in a wellbore, the assembly comprising: a mandrel with a flowbore in fluid communication with the tubular string, an upper sealing device, a lower sealing device, a selectively operable valve that enables or prevents fluid communication between the flowbore and the wellbore, and a selectively closeable bypass flow path. The tubular string may comprise coiled tubing, and at least one of the sealing devices may comprise a plurality of sealing elements. The assembly may further comprise a continuous J-slot, drag blocks, an upper anchor, and/or a lower anchor. The upper anchor may comprise a plurality of spring-loaded buttons activated by pressure when the bypass flow path is closed, and the lower anchor may comprise a slip and cone system.

BRIEF DESCRIPTION OF THE DRAWINGS

For a more detailed description of the present invention, reference will now be made to the accompanying drawings, wherein.

NOTATION AND NOMENCLATURE

Figure 1:
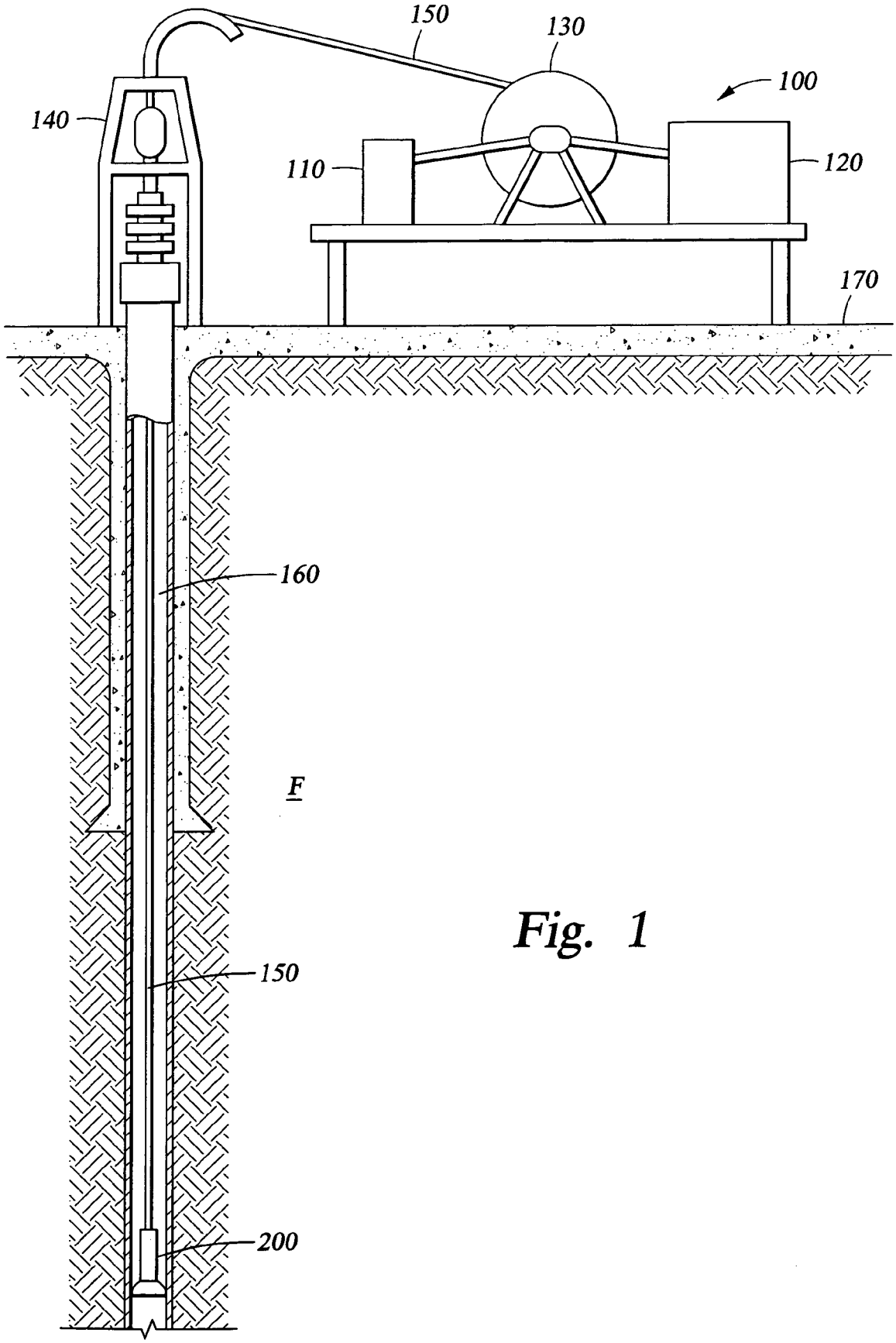
FIG. 1 provides a schematic side view, partially in cross-section, of a representative operational environment depicting a coiled tubing work string lowering one embodiment of a wellbore fluid saver assembly into a cased wellbore.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

As used herein, the term "tool" refers to the entire wellbore fluid saver assembly.

Reference to up or down will be made for purposes of description with "up", "upper", or "upstream" meaning toward the earth's surface or toward the entrance of a wellbore; and "down", "lower", or "downstream" meaning toward the bottom or terminal end of a wellbore.

In the drawings, the cross-sectional side views of the wellbore fluid saver assembly should be viewed from top to bottom, with the upstream end toward the top and the downstream end toward the bottom of the drawing.

DETAILED DESCRIPTION

A single embodiment of a wellbore fluid saver assembly, also referred to herein as "tool", and its method of operation will now be described with reference to the accompanying drawings, wherein like reference numerals are used for like features throughout the several views. There is shown in the drawings, and herein will be described in detail, a specific embodiment of the tool that connects to a coiled tubing work string to inject high pressure fluid, such as nitrogen, into a formation for fracturing. It should be understood that this disclosure is representative only and is not intended to limit the wellbore fluid saver assembly to use with a coiled tubing work string, to nitrogen as the pressurized fluid, or to fracturing as the only wellbore service operation, as illustrated and described herein. One skilled in the art will readily appreciate that the wellbore fluid saver assembly disclosed herein may be connected to any type of work string for wellbore servicing in general, and not only for fracturing. Furthermore, one skilled in the art will understand that other wellbore servicing liquids and gases could be used instead of nitrogen, such as, for example, water, acid, chemicals, or a combination thereof.

Figure 2:
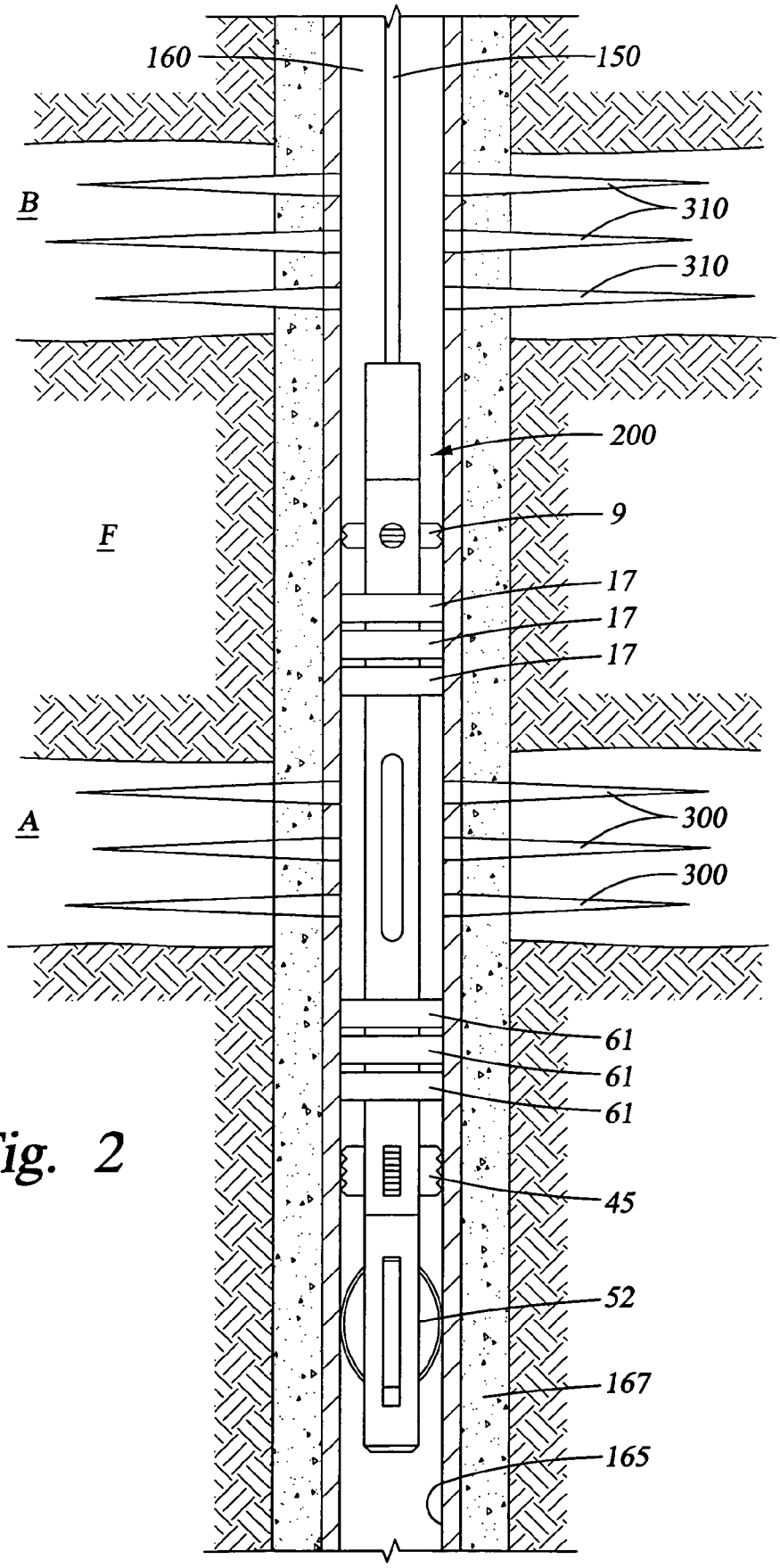
FIG. 2 provides a schematic side view of a wellbore fluid saver assembly located at a desired depth within the cased wellbore, with its upper and lower sealing elements set above and below a production zone, respectively.

FIG. 1 and FIG. 2 depict one representative wellbore servicing environment for the wellbore fluid saver assembly 200. FIG. 1 depicts a coiled tubing system 100 on the surface 170 and one embodiment of a wellbore fluid saver assembly 200 being lowered on coiled tubing 150 into a wellbore 160 extending into a surrounding formation F. The coiled tubing system 100 may include a power supply 110, a surface processor 120, and a coiled tubing spool 130. An injector head unit 140 feeds and directs the coiled tubing 150 from the spool 130 into the wellbore 160.

FIG. 2 depicts the wellbore fluid saver assembly 200 of FIG. 1 after it has been lowered to a desired depth and positioned in the wellbore 160. Specifically, upper sealing elements 17 and lower sealing elements 61, as well as anchoring upper buttons 9 and anchoring lower slips 45, are shown set against a casing 165 lining the wellbore 160. As set in this position, the tool 200 straddles a production zone "A" of interest, which has previously been perforated 300 through the casing 165 and cement 167 into the surrounding formation F. The upper sealing elements 17 and the lower sealing elements 61 of the tool 200 seal against the casing 165 to isolate the production zone A prior to fracturing.

Figure 3A:
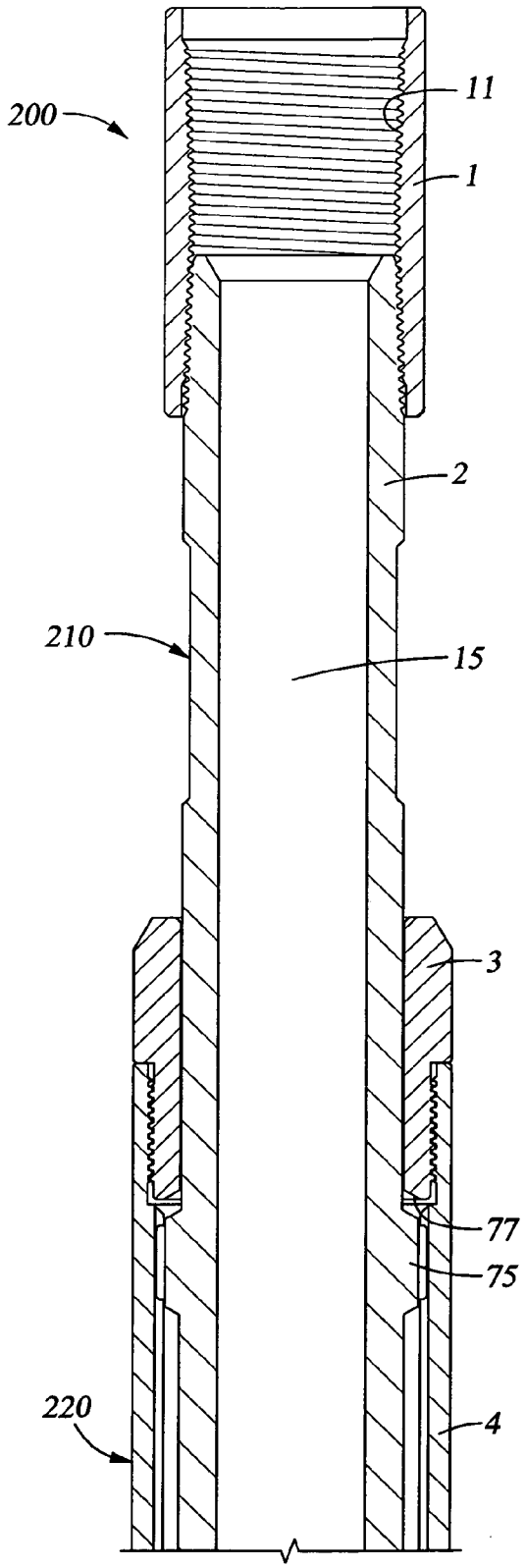
FIGS. 3A through 3H, when viewed sequentially from end-to-end, provide a cross-sectional side view from top to bottom of one embodiment of a wellbore fluid saver assembly.
Figure 3E:
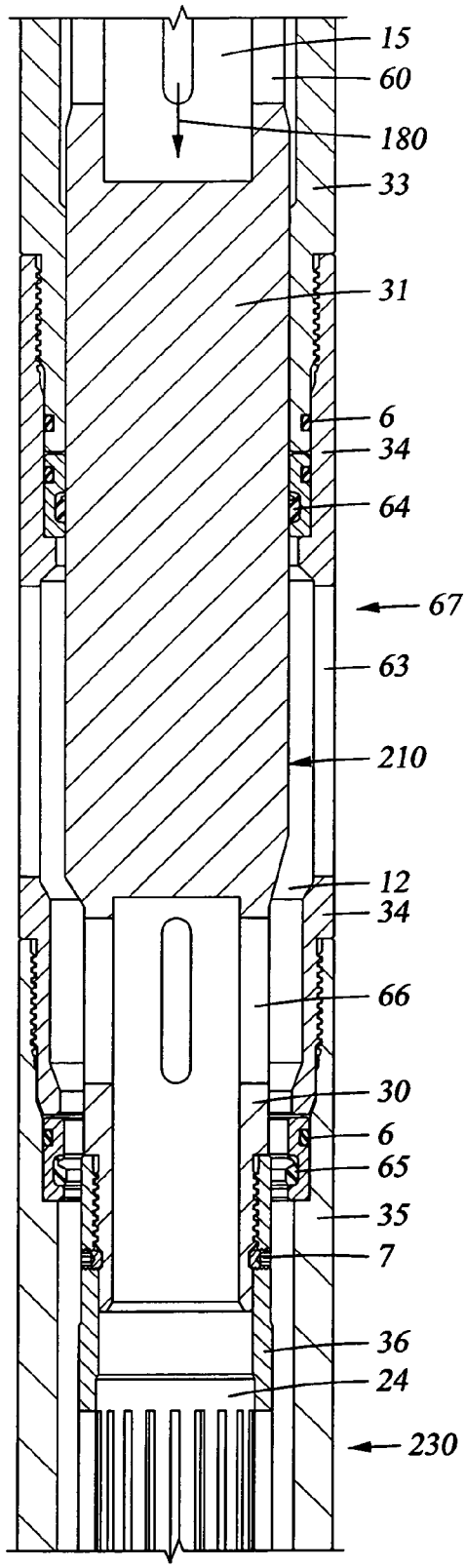
Figure 3B:
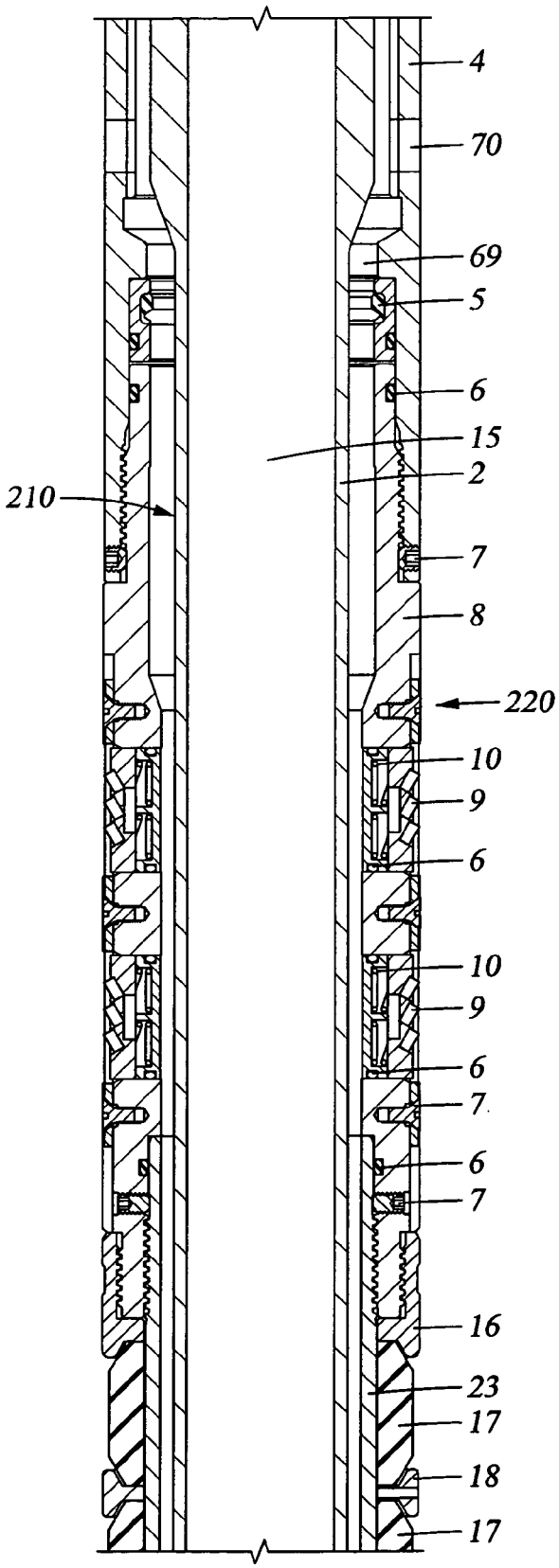
Figure 3F:
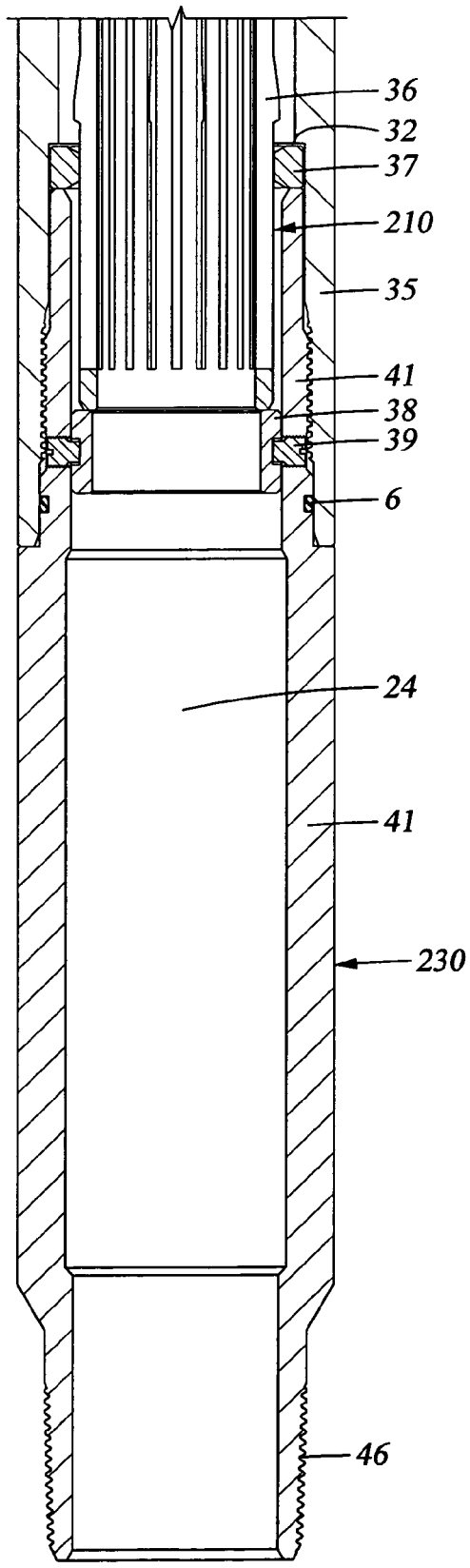
Figure 3C:
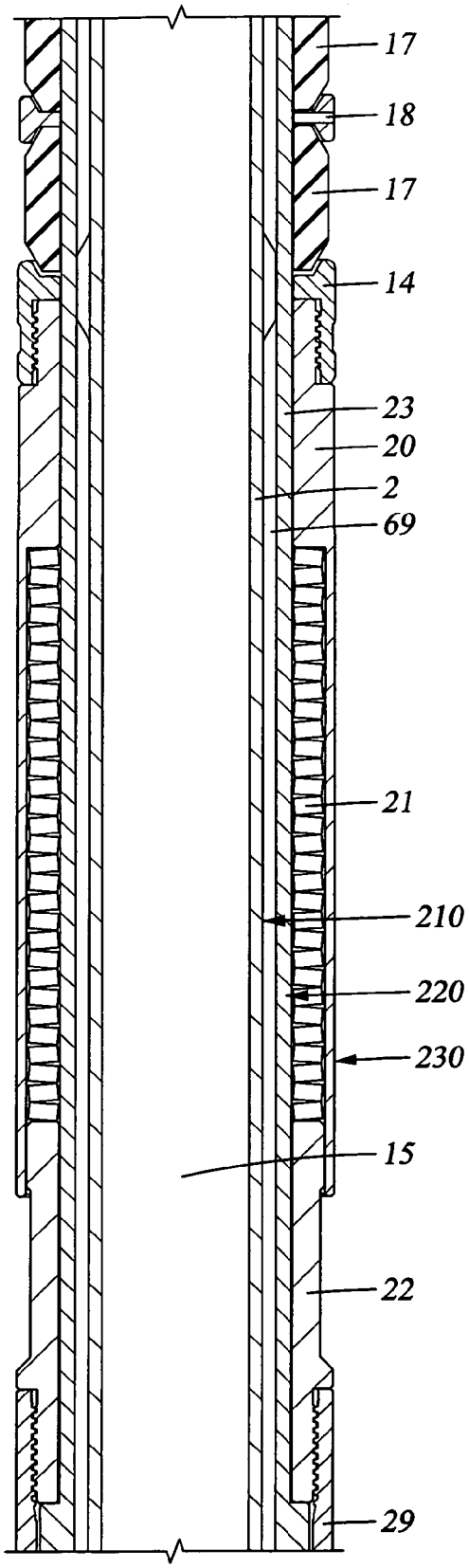
Figure 3G:
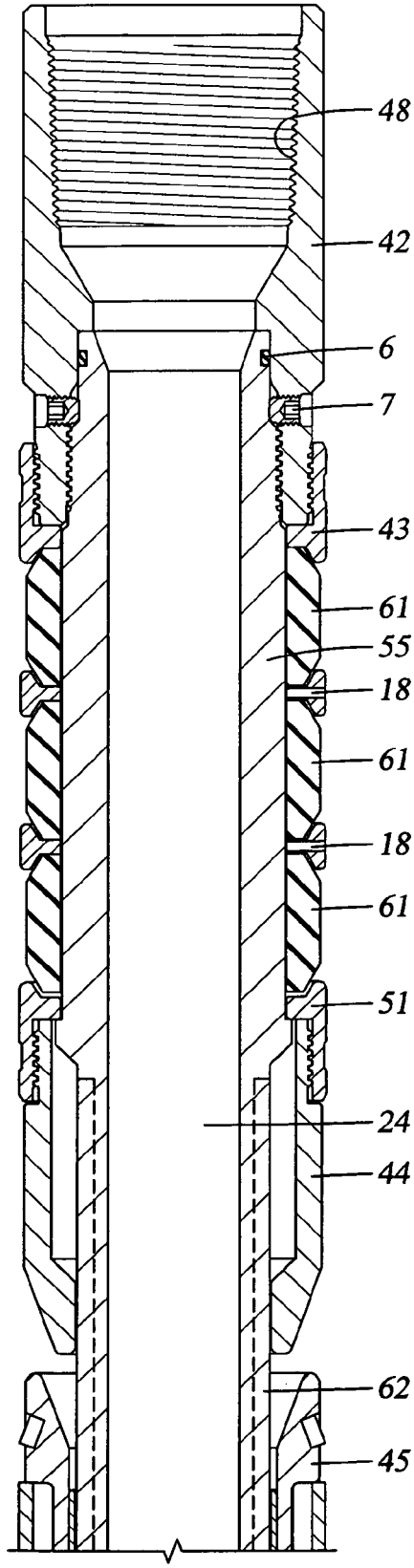
Figure 3D:
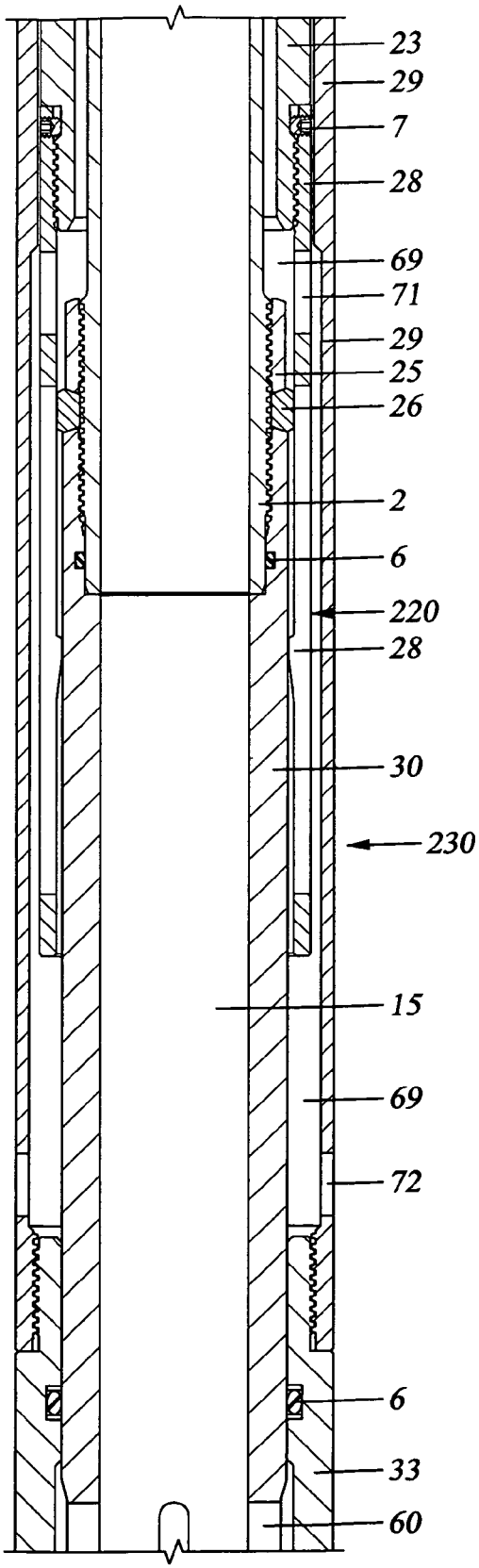

Referring now to FIGS. 3A through 3H, these cross-sectional side views depict the individual components of one embodiment of a wellbore fluid saver assembly 200. In particular, when viewed from end to end, FIGS. 3A through 3H represent a cross-sectional side view of the tool 200 from top to bottom. The assembly 200 comprises three partially concentric tubular systems 210, 220, 230 that reciprocate axially with respect to one another, and a lug assembly 68 at its lower end. An inner tubular system 210 comprises a threaded coupling 1, a top mandrel 2, a ported mandrel 30, and a lower collet 36 as depicted in FIGS. 3A through 3F. The threaded coupling 1 includes a box end 11 for connecting to the coiled tubing 150 and threads into the upper end of the top mandrel 2, which in turn threads into a lock ring 25 and the upper end of the ported mandrel 30 as shown in FIG. 3D. An upper collet ring 26 surrounds the lower end of the top mandrel 2 and axially resides between the lock ring 25 and the ported mandrel 30, which threads at its lower end into the lower collet 36 as shown in FIG. 3E. The ported mandrel 30 comprises valving ports 60, bypass ports 66 and a flow blocking section 31 that terminates an inner flowbore 15 extending through the threaded coupling 1, the top mandrel 2, and the ported mandrel 30.

A middle tubular system 220 surrounds the inner tubular system 210 and comprises a top sleeve cap 3, a top sleeve 4, a hold down body 8, a seal element mandrel 23, and an upper collet 28 as shown in FIGS. 3A through 3D. The top sleeve cap 3 threads into the top sleeve 4, which in turn threads onto the hold down body 8. The lower end of the hold down body 8 threads into a first gauge ring 16 and onto the seal element mandrel 23. The hold down body 8 includes a plurality of recesses within which are disposed piston buttons 9 biased to a retracted position by piston springs 10. The opposite end of the seal element mandrel 23 is threaded into the upper collet 28 as shown in FIG. 3D. The seal element mandrel 23 supports an upper set of sealing elements 17, with each individual sealing element 17 separated by spacers 18. The set of sealing elements 17 and spacers 18 reside axially between first and second gauge rings 16, 14 as shown in FIGS. 3B and 3C.

Referring now to FIGS. 3C through 3H, an outer tubular system 230 surrounds a portion of the middle tubular system 220 and a portion of the inner tubular system 210. The outer tubular system 230 comprises a spring housing 20, a sleeve cap 22, a connecting sleeve 29, a valve body 33, a ported sub 34, a lower collet housing 35, a bottom nipple 41, a lower packer top sub 42, a lower packer mandrel 55 and a bottom sub 56. The spring housing 20 threads into the second gauge ring 14, and a Belleville spring 21 is positioned axially between the spring housing 20 and the upper end of the sleeve cap 22 as shown in FIG. 3C. The lower end of the sleeve cap 22 threads into the connecting sleeve 29, which in turn threads onto the upper end of the valve body 33 as shown in FIGS. 3C and 3D. The lower end of the valve body 33 threads to the ported sub 34, which in turn threads into the lower collet housing 35 as shown in FIG. 3E. The lower end of the lower collet housing 35 threads onto the bottom nipple 41, and a lower collet ring 37 is shown axially positioned between the bottom nipple 41 and a shoulder 32 on the inner surface of the lower collet housing 35 as shown in FIG. 3F. A shear ring 38 receives a shear screw 39, which extends through the bottom nipple 41 to lock the outer tubular system 230 with respect to the inner tubular system 210.

Figure 3H:
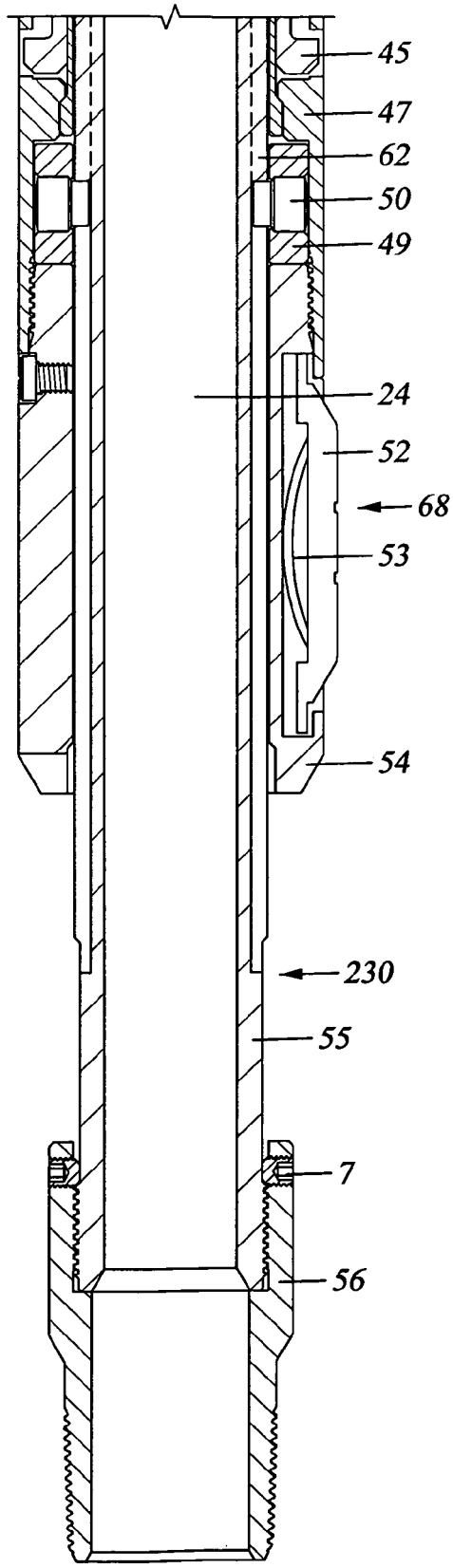

As depicted in FIGS. 3F and 3G, the bottom nipple 41 is provided with lower threads 46 to connect into a box end 48 of the lower packer top sub 42. A third gauge ring 43 threads between the lower packer top sub 42 and the lower packer mandrel 55. A fourth gauge ring 51 threads onto a cone 44 that is used to activate one or more slips 45. A lower set of sealing elements 61 resides between the third gauge ring 43 and the fourth gauge ring 51 with element spacers 18 provided between each of the individual sealing elements 61. A continuous J-slot 62 is formed into the outer surface of the lower packer mandrel 55 as shown in FIG. 3G. The lower end of the lower packer mandrel 55 threads into the bottom sub 56 as shown in FIG. 3H. The wellbore fluid saver assembly 200 also comprises a plurality of O-rings 6 for sealing between components of the tubular systems 210, 220, 230, as well as a plurality of set screws 7 for locking the various components of the tubular systems 210, 220, 230 together as depicted in FIG. 3A through 3H.

Figure 9:
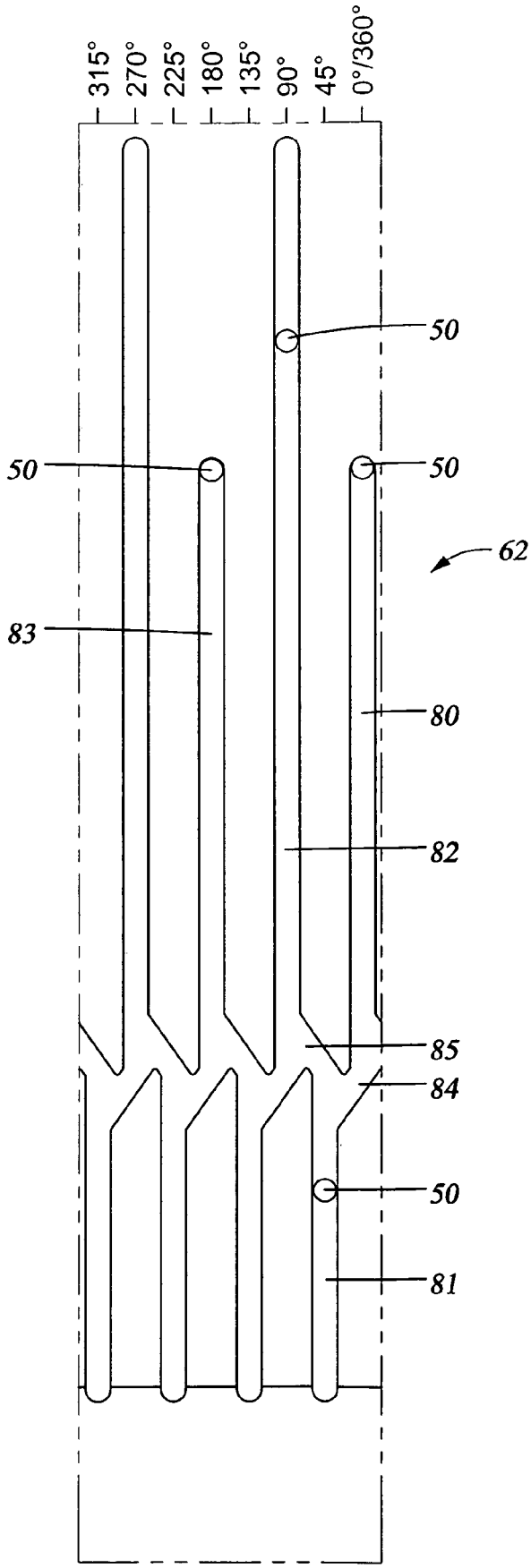
FIG. 9 provides a schematic cross-sectional side view of a J-slot and an interacting lug that form part of the wellbore fluid saver assembly.

Referring again to FIG. 3H, the lug assembly 68 comprises a slip cage 47, a lug ring 49 and a drag block body 54 containing a drag block 52 and a spring 53. The lug assembly 68 is disposed about the lower packer mandrel 55 and connects to the J-slot 62 by a lug 50 extending from the lug ring 49. The drag block body 54 threads into the slip cage 47, and the slips 45 extend upwardly from the slip cage 47 for interaction with the cone 44. The drag block 52 is attached to the drag block body 54 and biased radially outwardly by a drag block leaf spring 53 that is located in a cavity between the drag block body 54 and the drag block 52. The lug ring 49 and the lug 50 reside in recesses along the inner surface of the drag block body 54, with the lug 50 extending to engage the continuous J-slot 62. The interaction between the lug 50 and the continuous J-slot in various configurations of the tool 200 is also depicted in FIG. 9 and will be discussed in more detail herein.

Referring again to FIGS. 3B through 3E, the wellbore fluid saver assembly 200 also comprises a number of ports that provide various flow paths through the assembly 200. As shown in FIG. 3E, the ported mandrel 30 comprises inner valving ports 60 and the ported sub 34 comprises outer valving ports 63. As such, the ported mandrel 30 and ported sub 35 comprise a valve 67 that is open when the inner valving ports 60 and the outer valving ports 63 are at least partially aligned, and that is closed when these ports 60, 63 are totally out of alignment. Accordingly, when the valving ports 60, 63 are aligned, they allow communication of pressurized nitrogen 180 from the flowbore 15 to the surrounding wellbore 160.

The ported mandrel 30 also includes bypass ports 66 that interact with the outer valving port 63 when the valve 67 is closed to allow fluid communication along a lower bypass flow path 12 between a lower flowbore 24 and the wellbore 160. Referring to FIGS. 3B through 3D, an upper bypass flow path 69 is provided in a gap between the inner tubular system 210 and the middle tubular system 220, and this upper bypass flow path 69 is defined by bypass ports 70, 71, and 72 that are located in the top sleeve 4, the upper collet 28, and the connecting sleeve 29, respectively. Like the lower bypass flow path 12, the upper bypass flow path 69 is also open when the valve 67 is closed.

As shown in FIGS. 3B and 3E, in addition to the components introduced above, there are also three molded seals 5, 64, 65 that are important for directing the flow of pressurized nitrogen 180 through the bypass flow paths 12, 69, or through the valve 67, or both. The upper molded seal 5 is located near the interface between the top sleeve 4 and the hold down body 8 as shown in FIG. 3B. When the upper bypass flow path 69 is open, namely, when flow is permitted through ports 72, 71 and 70, the upper molded seal 5 prevents such flow from actuating the piston buttons 9. The central molded seal 64 is located between the valve body 33 and the ported sub 34, and the lower molded seal 65 is located near the interface between the ported sub 34 and the lower collet housing 35 as shown in FIG. 3E. Both of these molded seals 64, 65 prevent the loss of pressurized nitrogen 180 from the valve 67 when the valve 67 is open and the bypass flow paths 12, 69 are closed.

The wellbore fluid saver assembly 200 assumes various operational configurations during fracturing of the formation F surrounding the wellbore 160, which include not only the actual fracturing process, but also run-in and movement of the tool 200 from one production zone to the next. The remaining figures illustrate the sequential operational configurations of the wellbore fluid saver assembly 200 during wellbore fracturing. In general, as will be described in more detail herein, FIGS. 4A through 4F depict the wellbore fluid saver assembly 200 as configured during run-in; FIGS. 5A through 5F depict the assembly 200 located adjacent to the production zone of interest and ready to set; FIGS. 6A through 6F show the tool 200 anchored, the upper and lower sets of sealing elements 17, 61 set, and the valve 67 partially open to allow communication of the pressurized fluid 180 between the flowbore 15 and the surrounding wellbore 160; FIGS. 7A through 7F depict the valve 67 fully open, as it will be during the fracturing operation; and FIGS. 8A through 8F depict the valve 67 closed after completion of the fracturing operation with the tool 200 being moved by the coiled tubing 150 to the next production zone or being removed from the wellbore 160.

Figure 4A:
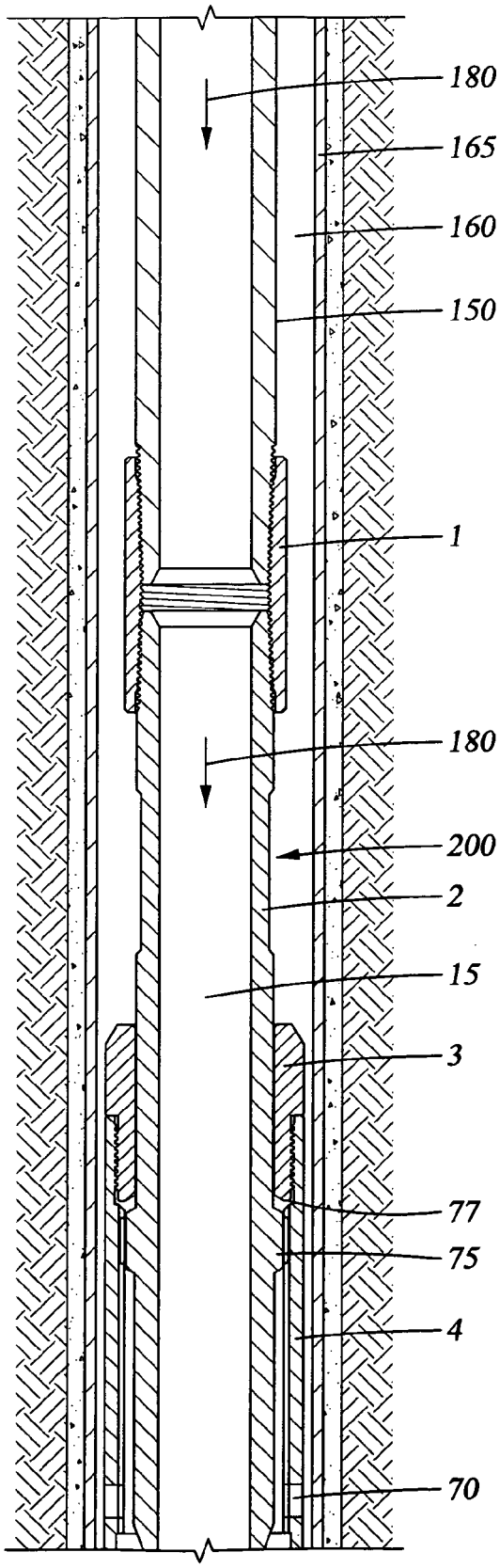
FIGS. 4A through 4F, when viewed sequentially from end-to-end, provide a cross-sectional side view of the wellbore fluid saver assembly of FIG. 3 in a run-in configuration.
Figure 5A:
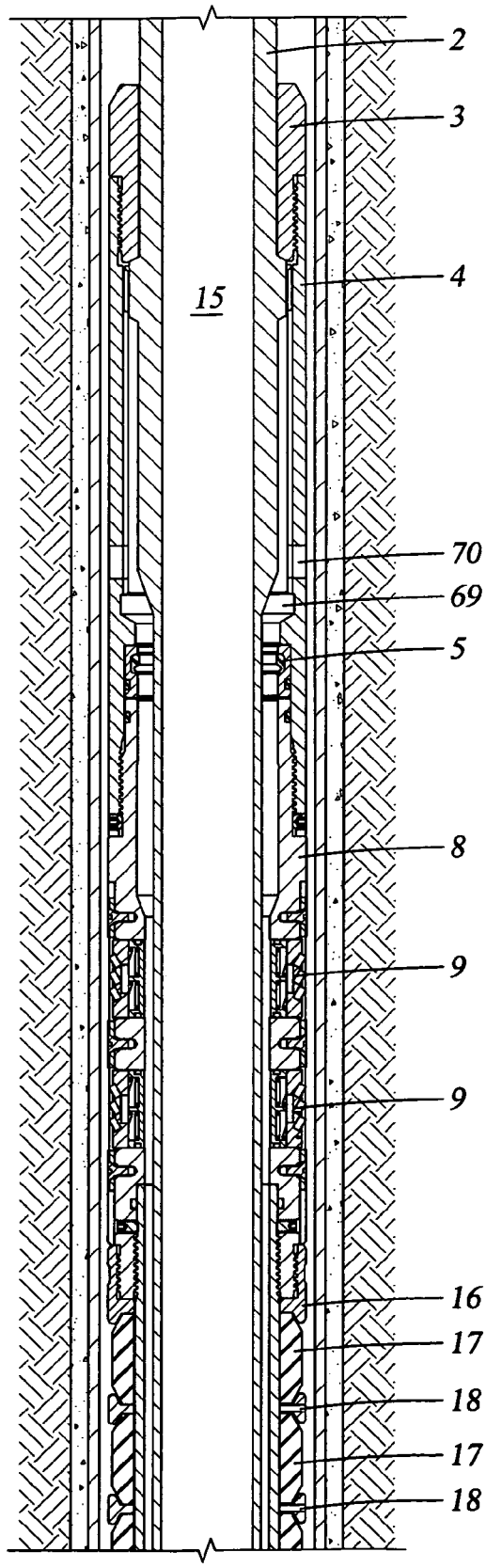
FIGS. 5A through 5F, when viewed sequentially from end-to-end, provide a cross-sectional side view of the wellbore fluid saver assembly positioned at a desired depth in the wellbore and ready to set.
Figure 4B:
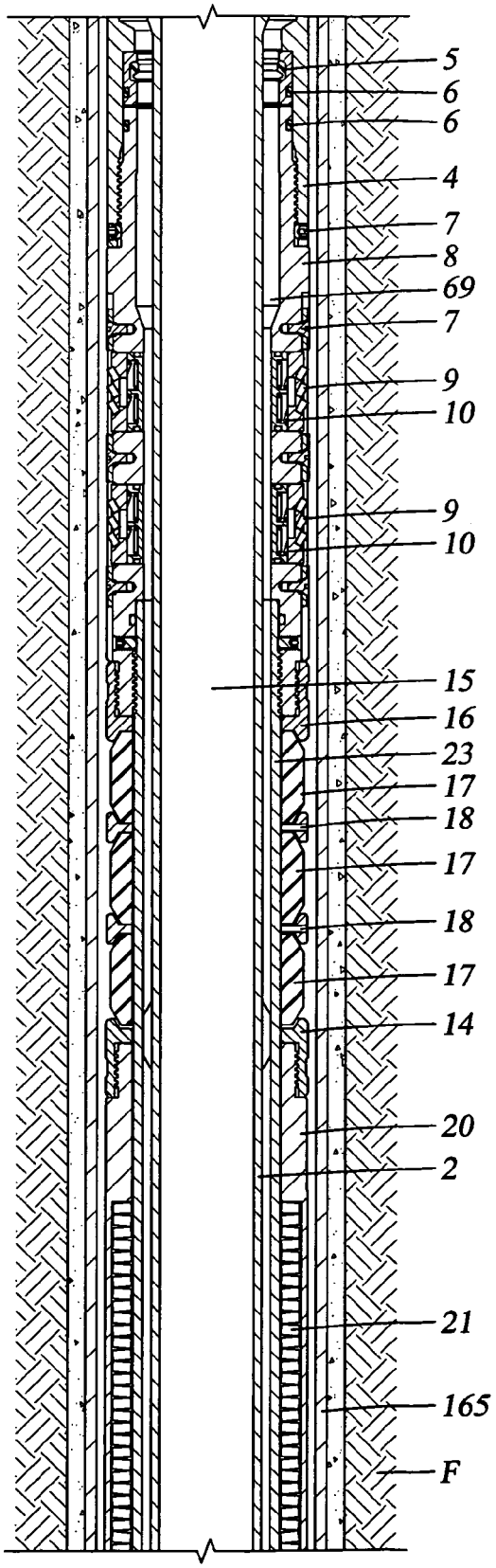
Figure 5B:
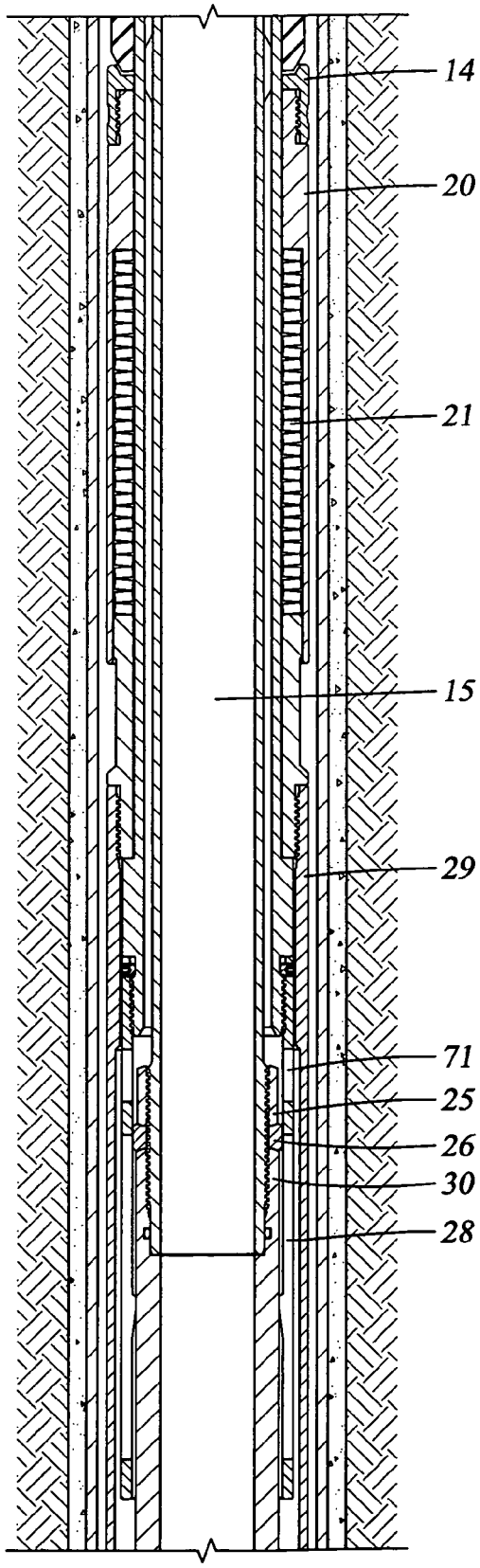
Figure 4C:
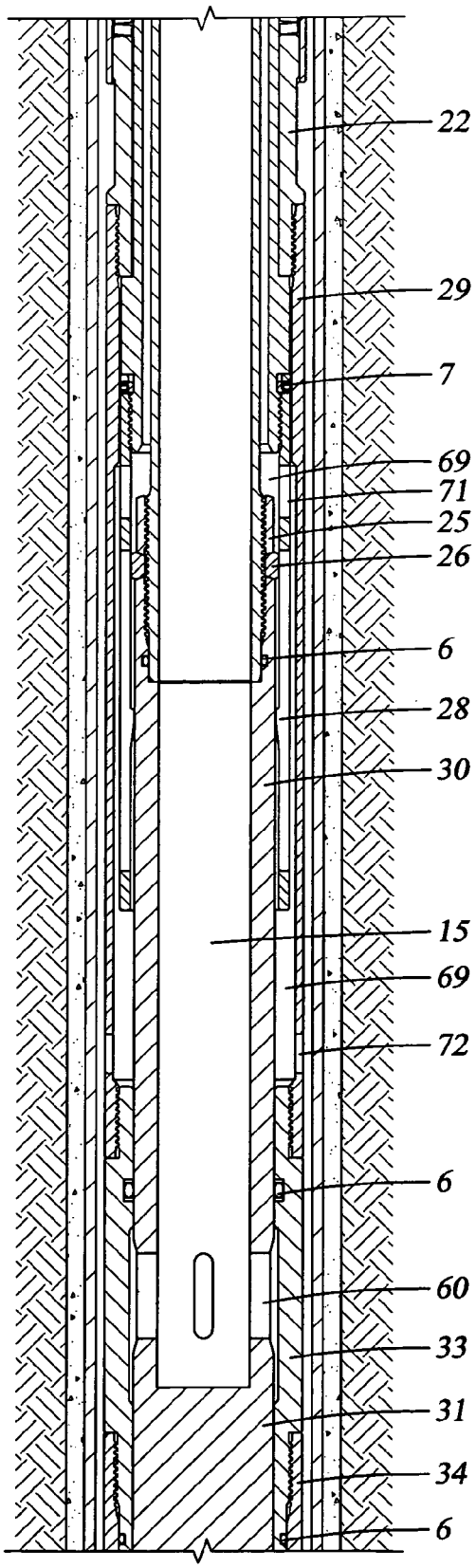
Figure 4D:
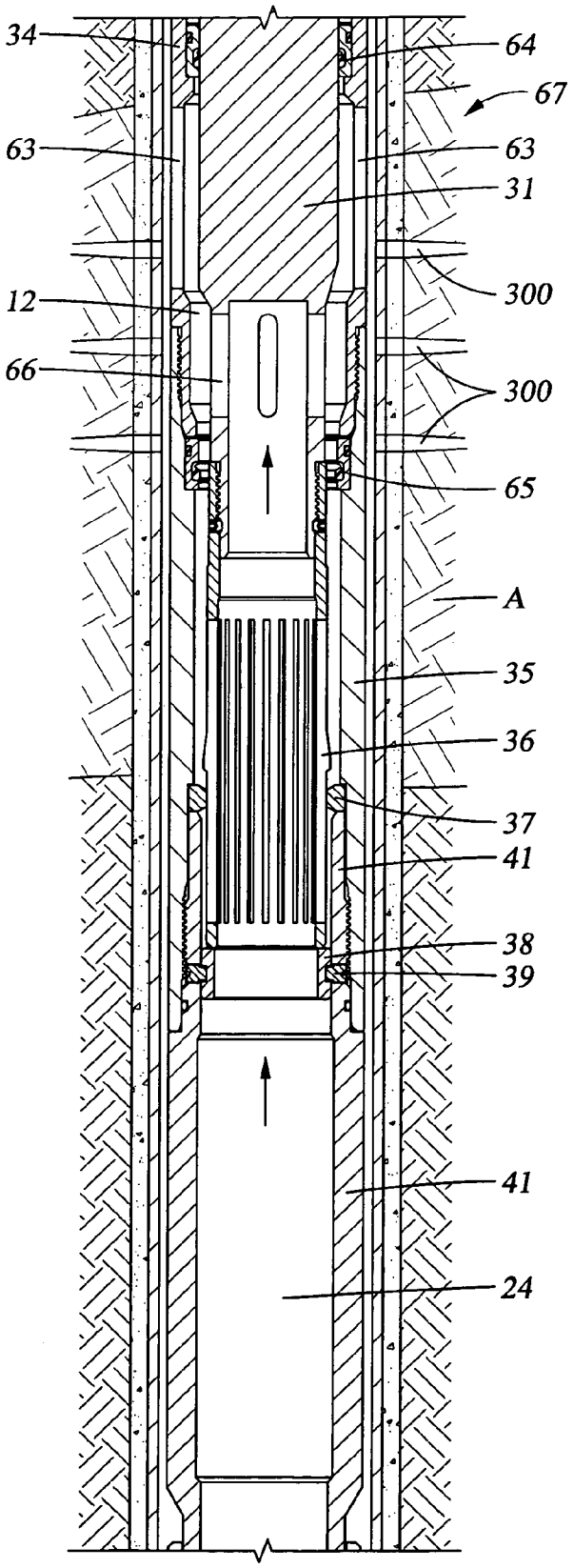
Figure 4E:
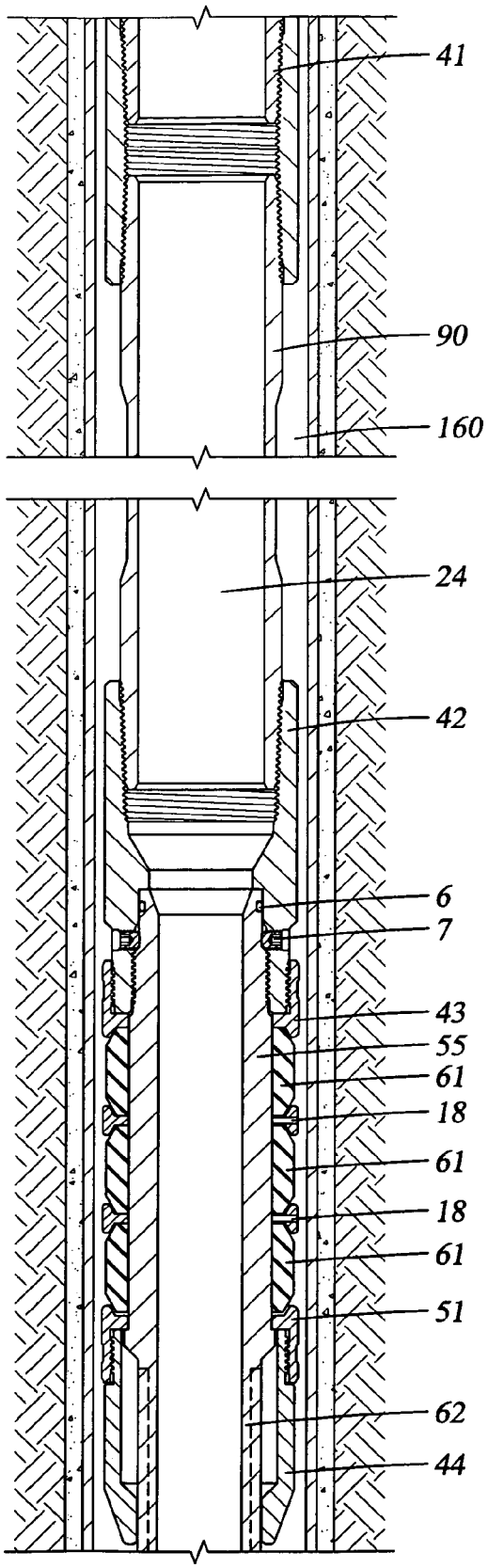
Figure 5E:
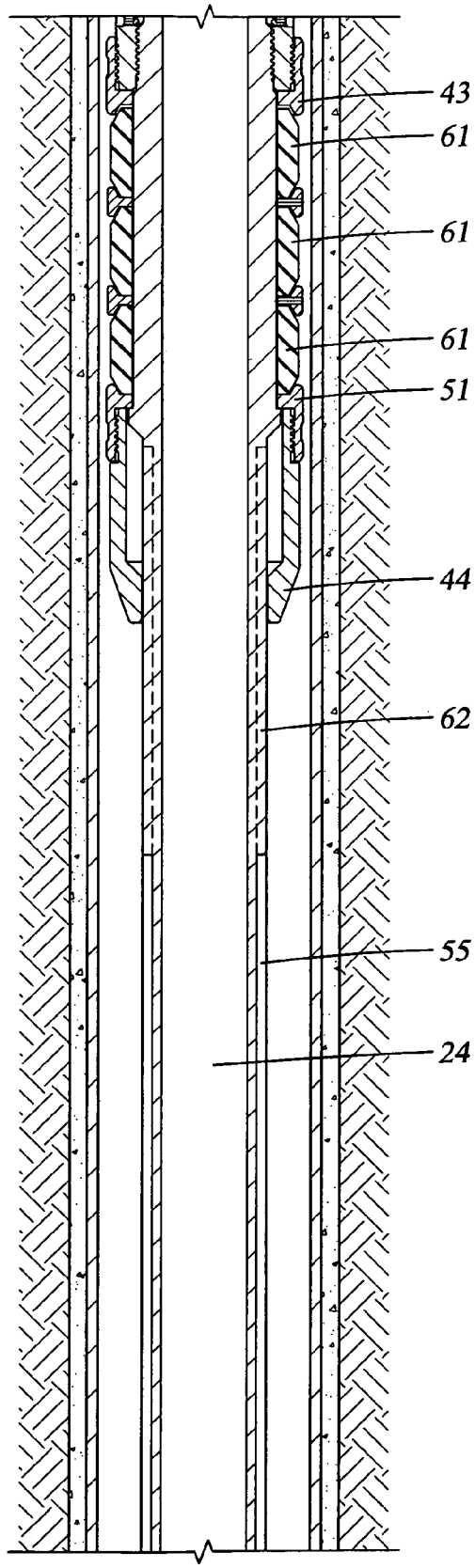
Figure 4F:
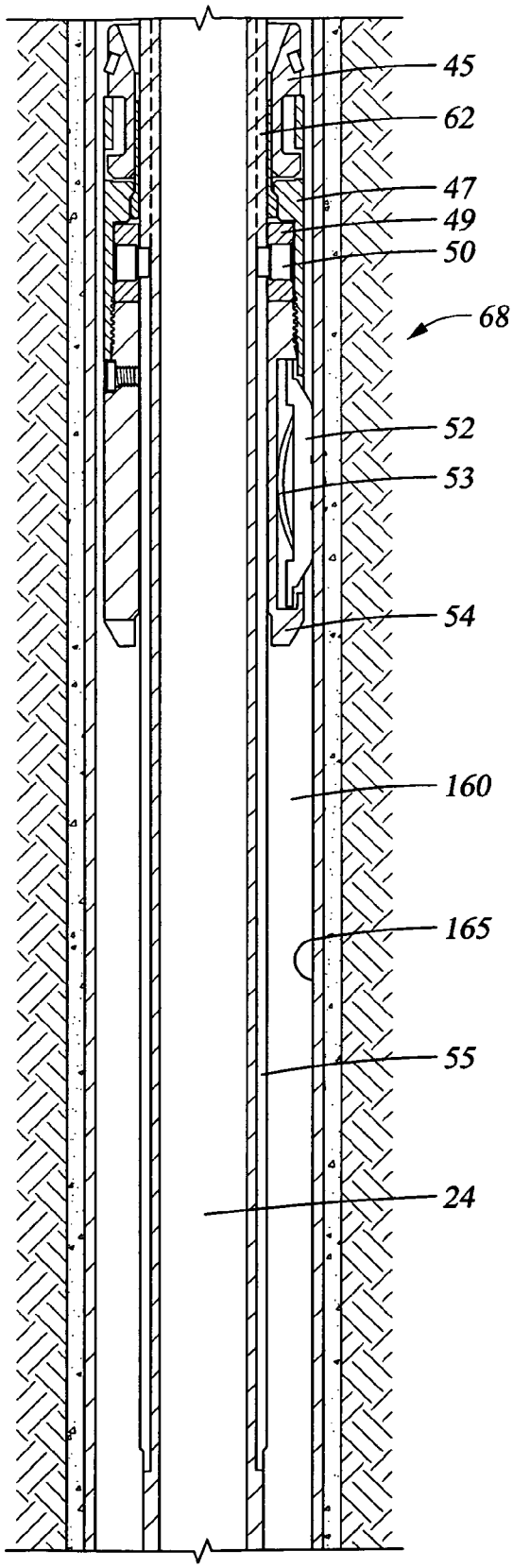

Referring now to FIGS. 4A through 4F, the tool 200 is shown in its run-in configuration, i.e. the configuration of the tool 200 as it is lowered or "run-in" to the wellbore 160 to a desired depth adjacent to a production zone A shown in FIG. 4D. During run-in, the operator may elect to begin pumping pressurized nitrogen 180 to fill the coiled tubing 150. Valve 67 is closed, because the inner valving ports 60 and outer valving ports 63 are totally out of alignment, and the flow blocking section 31 is blocking flow of the nitrogen 180 through outer valving ports 63 as shown in FIG. 4D. Thus, the pressurized nitrogen 180 being pumped into the coiled tubing 150 at the surface 170 is contained within the coiled tubing 150 and prevented from communicating with the surrounding formation F. As the assembly 200 is run-in, the drag blocks 52 shown in FIG. 4F are in continuous contact with the casing 165, providing a centralizing effect as the tool 200 is lowered into the wellbore 160.

As shown in FIGS. 4B through 4D, during run-in the bypass flow paths 12, 69 are open, as indicated by the position of bypass ports 66, 70, 71 and 72 relative to the upper, middle, and lower molded seals 5, 64 and 65. As the wellbore fluid saver assembly 200 is run-in, a differential pressure distribution develops along the length of the tool 200. The faster the speed of run-in, the higher the differential pressure along the tool 200. If this pressure differential is high enough, the fluid pressure can compress or set the upper set of sealing elements 17 and the lower set of sealing elements 61. Therefore, to equalize the pressure distribution along the tool 200, and thereby prevent compression of the upper set of sealing elements 17 and the lower set of sealing elements 61, wellbore fluid bypasses both sets of elements 17, 61. Specifically, as shown in FIGS. 4C and 4D, the wellbore fluid flows upwardly through a lower flowbore 24 in the tool 200 that is blocked at its upper end by the flow blocking section 31 in the ported mandrel 30, and then through the bypass ports 66 into the lower bypass flow path 12 and out into the wellbore 160 through outer valving ports 63. Simultaneously, as shown in FIGS. 4A through 4C, the wellbore fluid is routed along the upper bypass flow path 69 by flowing into ports 72, through ports 71, and out of ports 70 into the wellbore 160. This bypass flow does not actuate the piston buttons 9 due to the position of the upper molded seal 5, which prevents the piston buttons 9 from being exposed to internal pressure. The piston buttons 9 are pressure-actuated to extend outwardly and act as a locking device near the upper set of sealing elements 17. During run-in, it is desirable to avoid locking the tool 200 in this manner.

Referring to FIGS. 4D through 4F, also during run-in, it is desirable to avoid inadvertent anchoring of the tool 200 near the lower set of sealing elements 61. The cone 44 and the slips 45, when engaged, anchor the tool 200 against the casing 165. Therefore, to prevent the cone 44 from inadvertently engaging the slips 45, a shear ring 38 and shear screw 39 shown in FIG. 4D are provided to lock the lower collet 36 to the bottom nipple 41 such that these components do not move relative to each other during run-in. The force exerted on the coiled tubing 150 during run-in is insufficient to sever the shear screw 39. As long as the shear screw 39 engages the shear ring 38, the cone 44 is prevented from moving relative to and sliding under the slips 45. The shear ring 38 and shear screw 39 also prevent excessive wear on the lower collet 36, which would otherwise bear the load carried by the shear ring 38. Referring to FIG. 4F, the interaction between the continuous J-slot 62 and the lug 50 similarly prevents the lug assembly 68 from pushing the slips 45 upward relative to the cone 44 and engaging the cone 44. As shown in FIG. 9, lug 50 is located in slot 80 during run-in. This slot 80 is a shorter slot designed to prevent the lug assembly 68 from pushing the slips 45 upward relative to the cone 44 and engaging the cone 44. Due to the position of the lug 50 within slot 80, the lug assembly 68 is dragged along the casing 165 as the coiled tubing 150 lowers the wellbore fluid saver assembly 200 downhole.

Figure 5C:
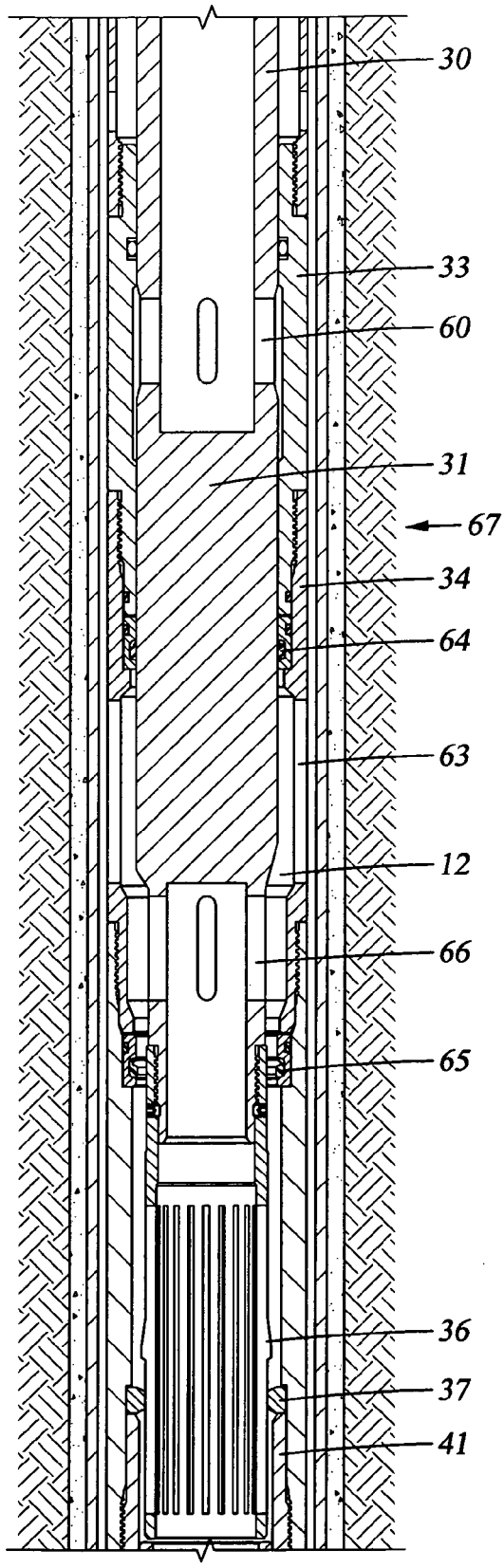
Figure 5D:
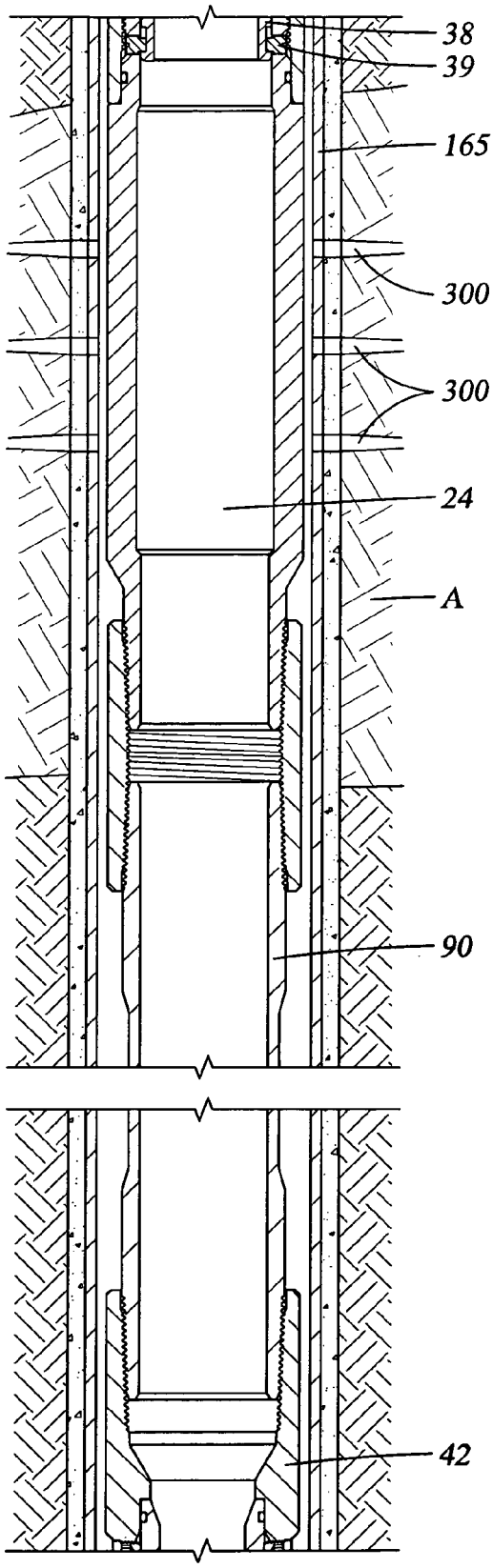
Figure 5F:
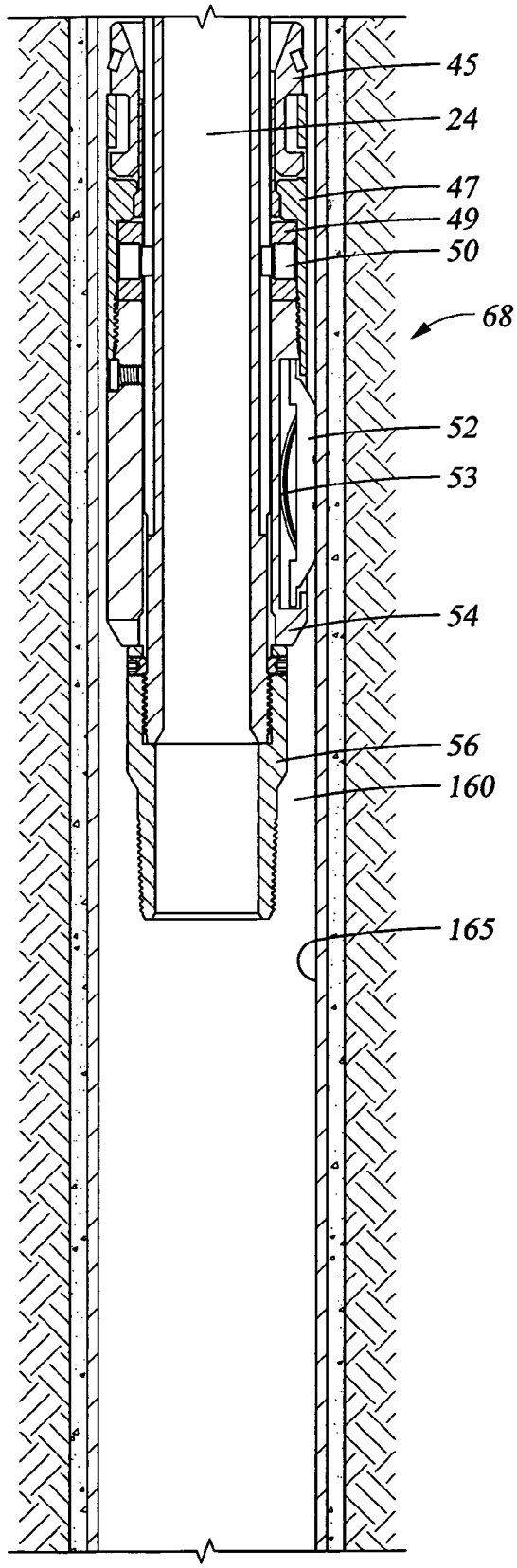
Figure 7A:
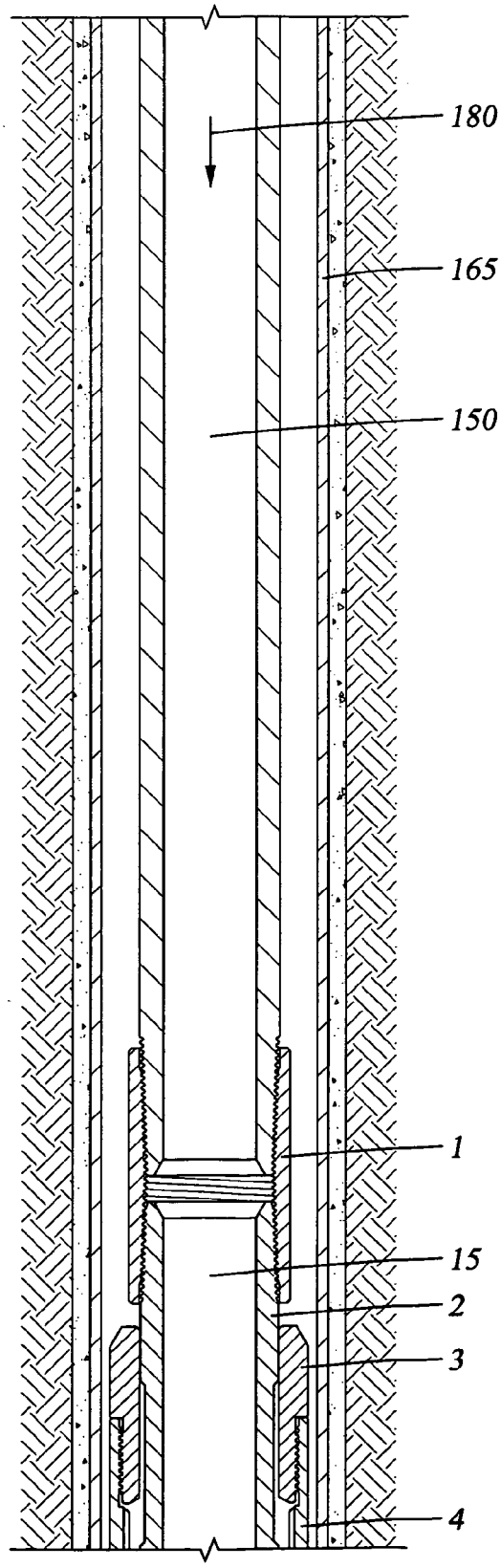
FIGS. 7A through 7F, when viewed sequentially from end-to-end, provide a cross-sectional side view of the wellbore fluid saver assembly with the valve fully opened during fracturing.

After run-in is complete and the tool 200 has reached a desired depth adjacent to a production zone A, the operator prepares the tool 200 to set. FIGS. 5A through 5F show the tool 200 in its ready to set configuration. To move the tool 200 from the run-in configuration of FIGS. 4A through 4F to the ready to set configuration, the operator simply picks up the coiled tubing 150, and therefore the attached tool 200. During this lifting process, the shear screw 39 and shear ring 38 remain intact as shown in FIG. 5D, the valve 67 remains closed as shown in FIG. 5C, thus keeping nitrogen 180 contained within the coiled tubing 150, and the bypass flow paths 12, 69 remain open. As shown in FIG. 5F, when the tool 200 is picked up, the resistance provided by the drag blocks 52 at the casing 165 allow the coiled tubing 150, the inner tubular system 210, the middle tubular system 220, and the outer tubular system 230 to travel upwards relative to the stationary lug assembly 68 until the bottom sub 56 contacts the lower end of the drag block body 54. Simultaneously, as represented in FIG. 9, the continuous J-slot 62 slides from an initial position at the top of slot 80 downwardly along lug 50 until the lug 50 contacts angled channel 84 of the continuous J-slot 62, thereby causing the lug ring 49 to rotate. The rotation of the lug ring 49 shifts lug 50 downwardly into the adjacent slot 81 along the continuous J-slot 62 to prepare for the next operational step of the tool 200, which is to set and anchor.

FIGS. 6A through 6F show the tool 200 in its set and anchored position. To move the tool 200 from the ready to set configuration of FIGS. 5A through 5F to the set and anchored position, the operator slacks off weight, meaning a downward force is applied to the coiled tubing 150. Referring again to FIG. 9, with the lug 50 in slot 81 at the onset of slack off, the downward force on the tool 200 causes slot 81 of the continuous J-slot 62 to slide along lug 50 until the lug 50 contacts angled channel 85 of the J-slot 62, thereby causing the lug ring 49 to rotate and the lug 50 to shift from slot 81 to adjacent slot 82. Referring again to FIGS. 6A through 6F, as slack off continues, the cone 44 engages the slips 45 to extend the slips 45 outwardly into engagement with the casing 165 as shown in FIG. 6F, thus anchoring the tool 200 near the lower set of sealing elements 61.

Figure 6A:
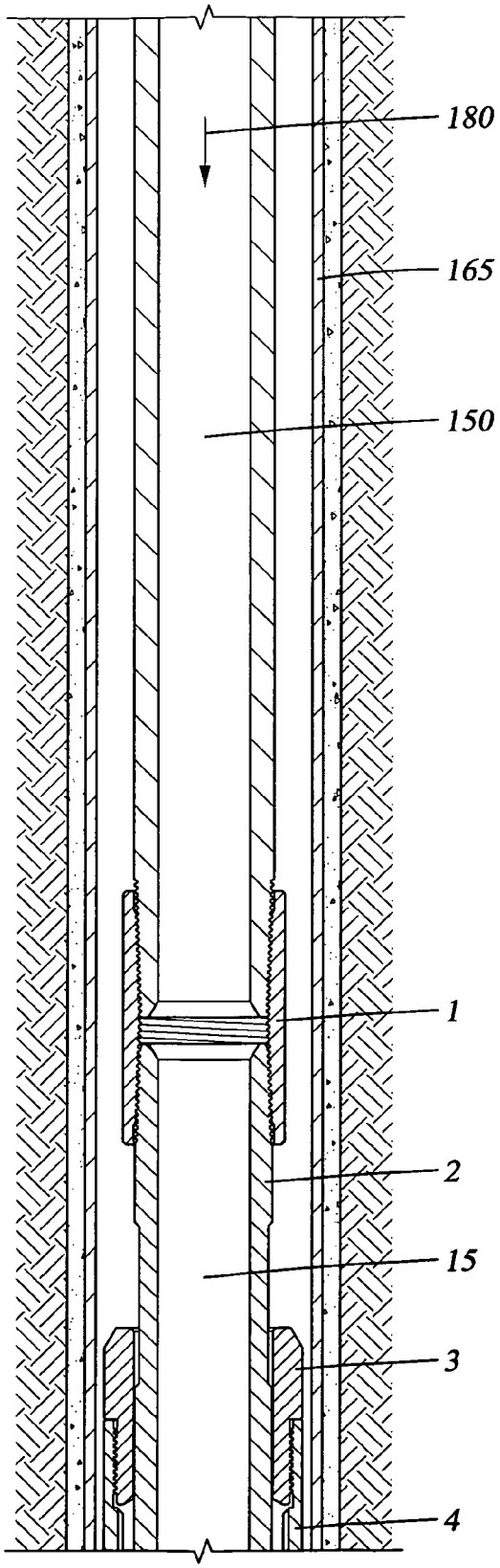
FIGS. 6A through 6F, when viewed sequentially from end-to-end, provide a cross-sectional side view of the wellbore fluid saver assembly anchored within the wellbore, a bypass flow path open, upper and lower sealing elements set, and a valve partially open.
Figure 6B:
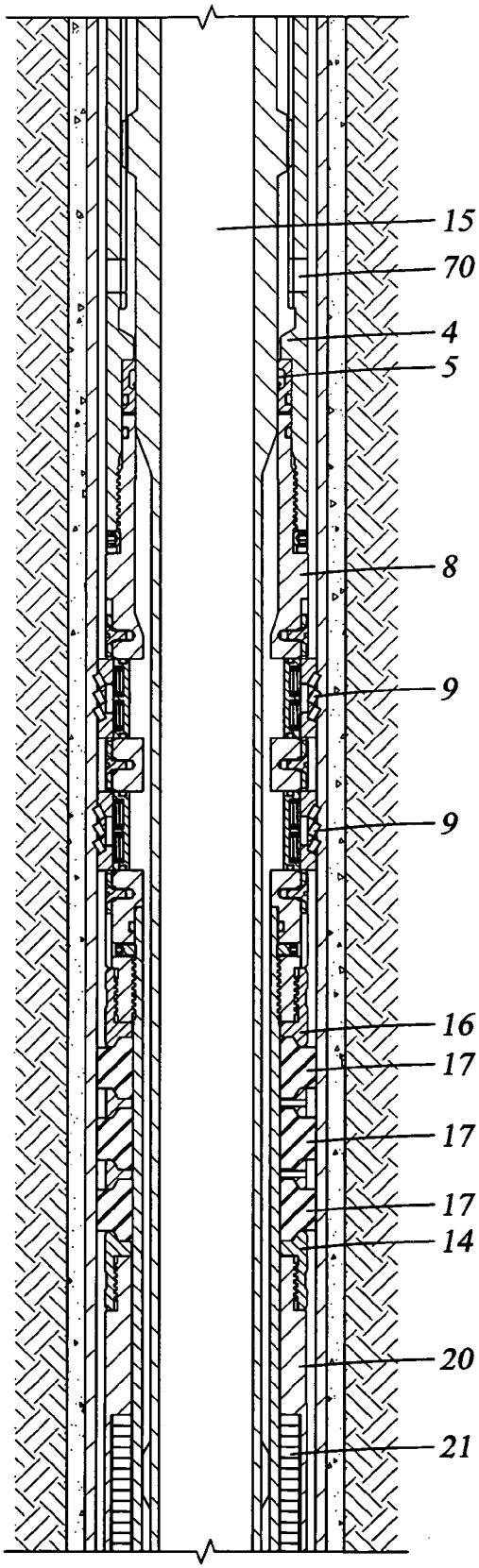
Figure 6D:
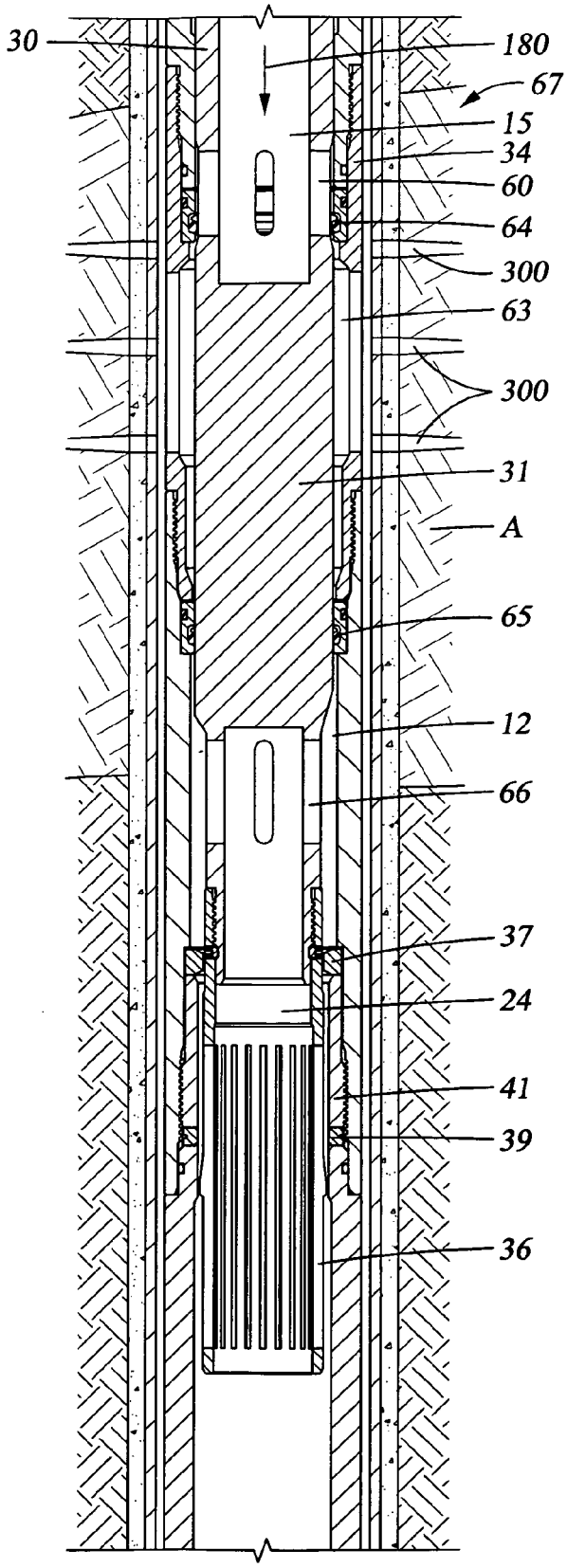
Figure 6E:
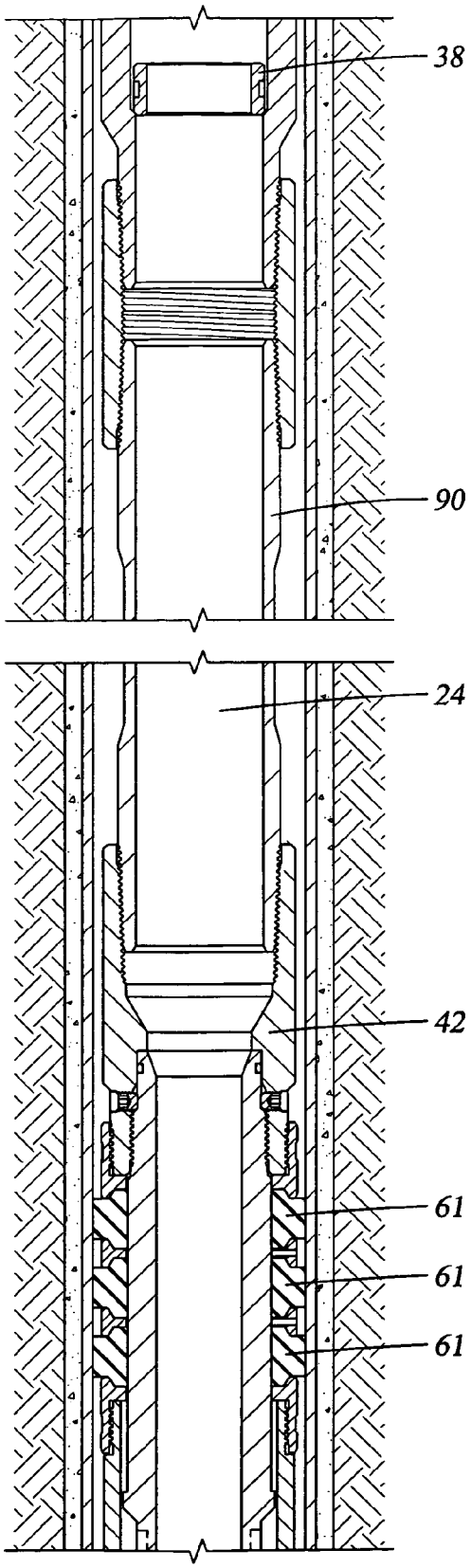
Figure 7E:
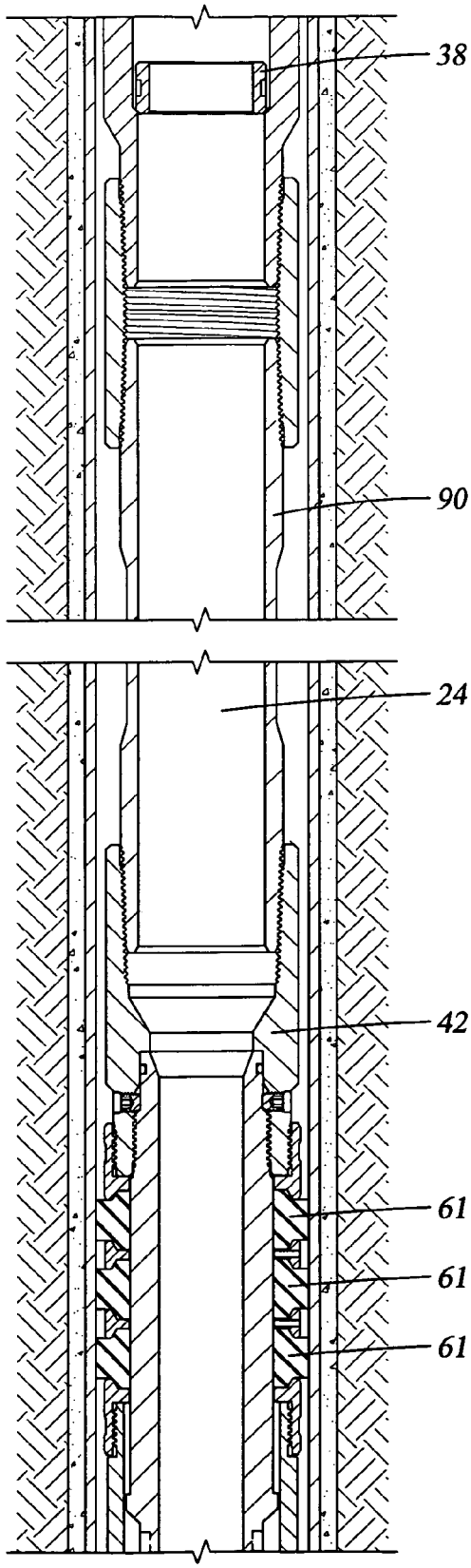
Figure 6F:
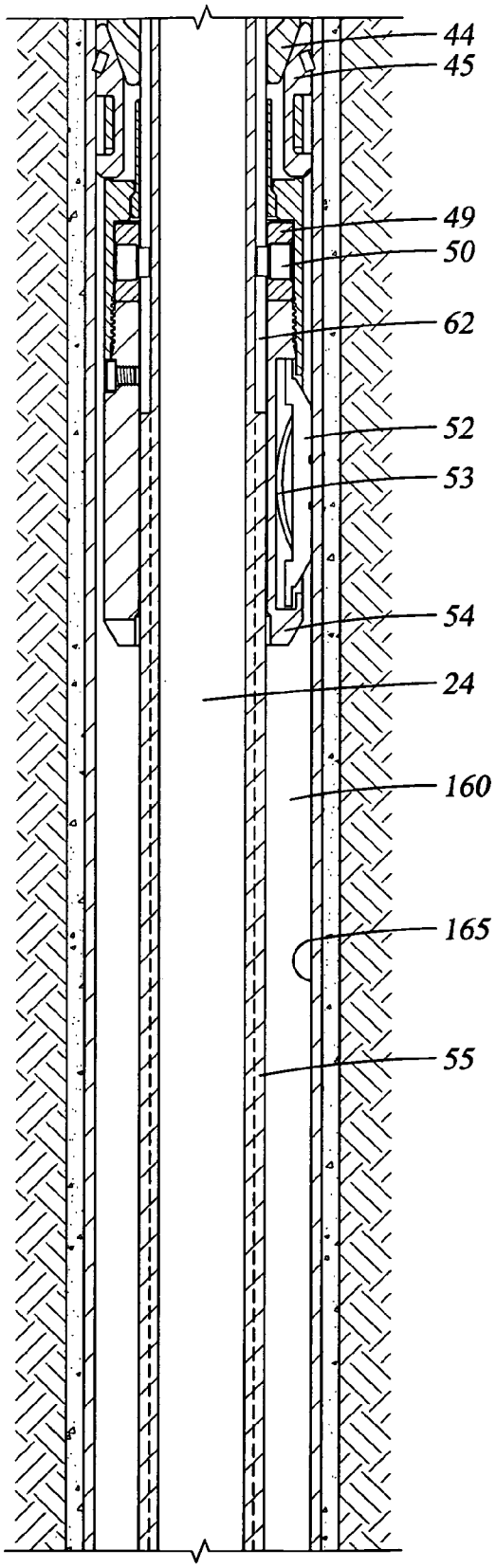
Figure 7F:
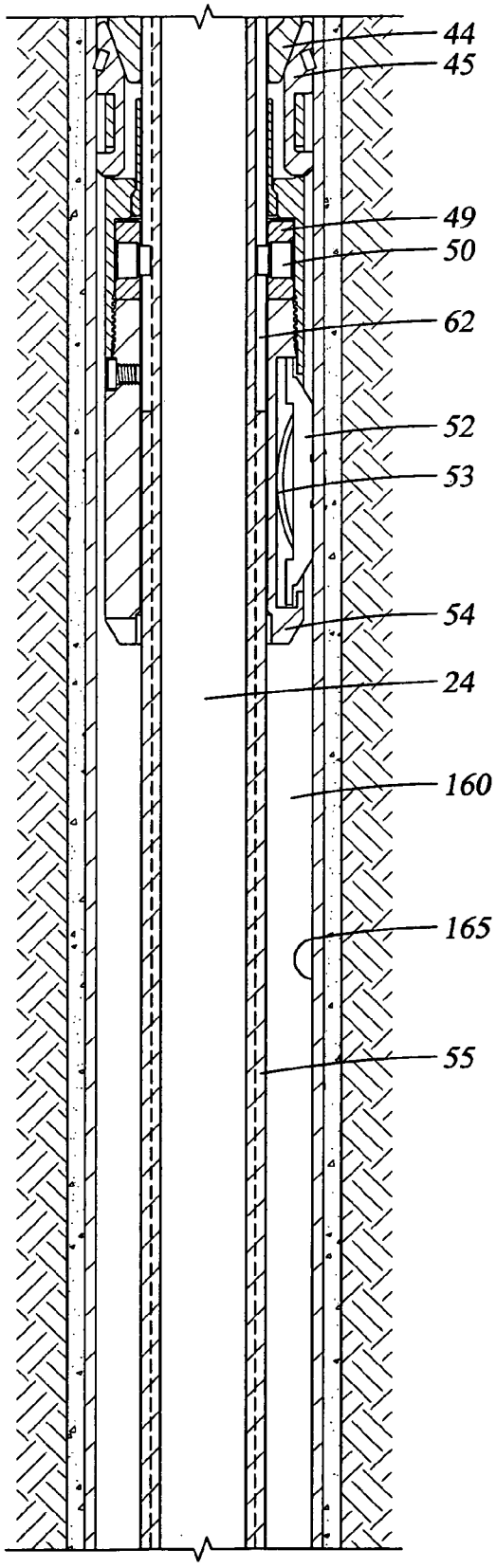

Further slack off compresses the upper set of sealing elements 17 as shown in FIG. 6B and the lower set of sealing elements 61 as shown in FIG. 6E, severs the shear screw 39 so that it no longer engages the shear ring 38 as shown in FIGS. 6D and 6E, and causes the lower collet 36 to overcome the lower collet ring 37 as shown in FIG. 6D. Referring to FIG. 6D, the lower molded seal 65 is positioned to block the lower bypass flow path 12 such that flow is no longer permitted to bypass the lower set of sealing elements 61 by flowing through the bypass ports 66 outwardly through the outer valving ports 63 into the wellbore 160. Also, as shown in FIG. 6B, due to the position of the upper molded seal 5 relative to bypass ports 70 in the top sleeve 4, flow is no longer permitted to travel along the upper bypass flow path 69 to bypass the upper set of sealing elements 17 and the piston buttons 9. As shown in FIG. 6D, the valve 67 is partially open because the inner valving ports 60 and outer valving ports 63 are partially aligned, so high pressure nitrogen 180 therefore flows from the coiled tubing 150 through the flowbore 15 and outwardly through the valve 67. This pressure activates the piston buttons 9, which "grip" the casing 165, thus locking the tool 200 against the casing 165 near the upper set of sealing elements 17 as shown in FIG. 6B. Thus, in summary, FIGS. 6A through 6F show the tool 200 anchored by slips 45 and piston buttons 9 and sealed against the casing 165 by the upper set of sealing elements 17 and the lower set of sealing elements 61, with the bypass flow paths 12, 69 closed, and the valve 67 partially open. In this configuration, the tool 200 has isolated production zone A. An extension 90 may be required in the assembly 200 to provide the proper spacing between the upper set of sealing elements 17 and the lower set of sealing elements 61, depending upon the length of the production zone A to be isolated.

Figure 7B:
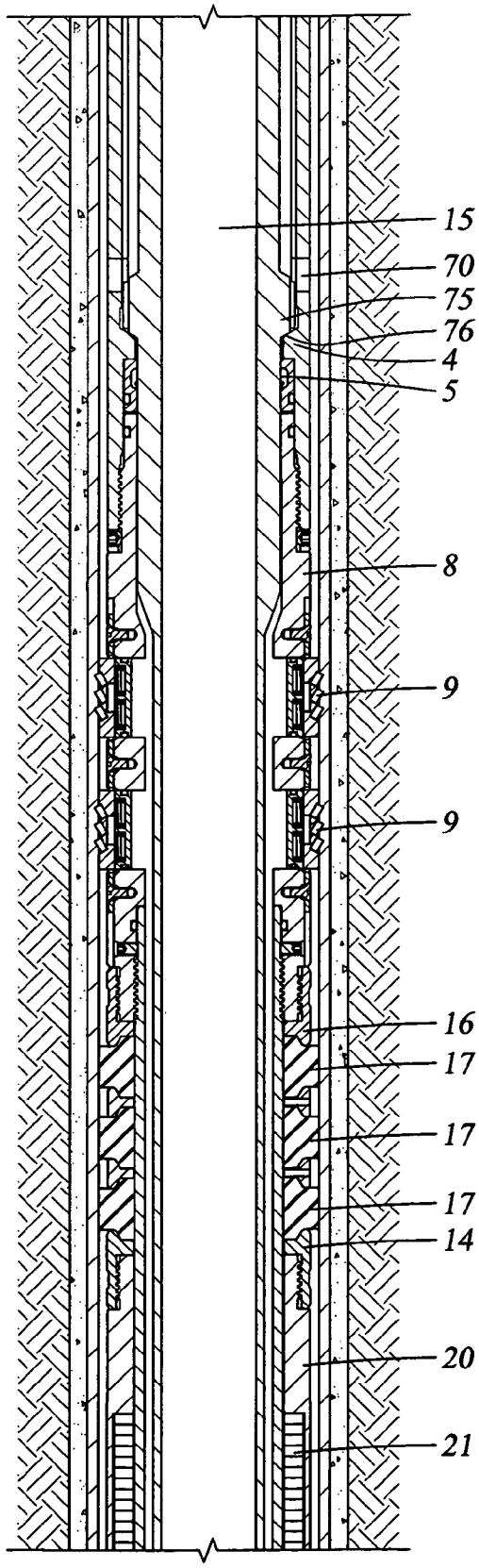
Figure 6C:
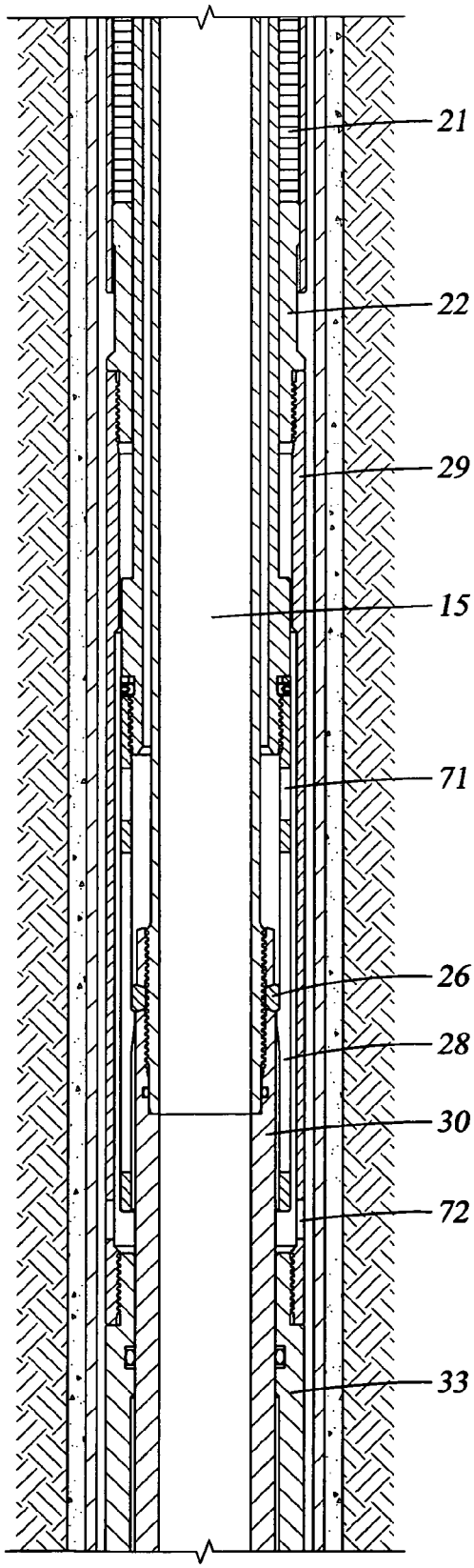
Figure 7C:
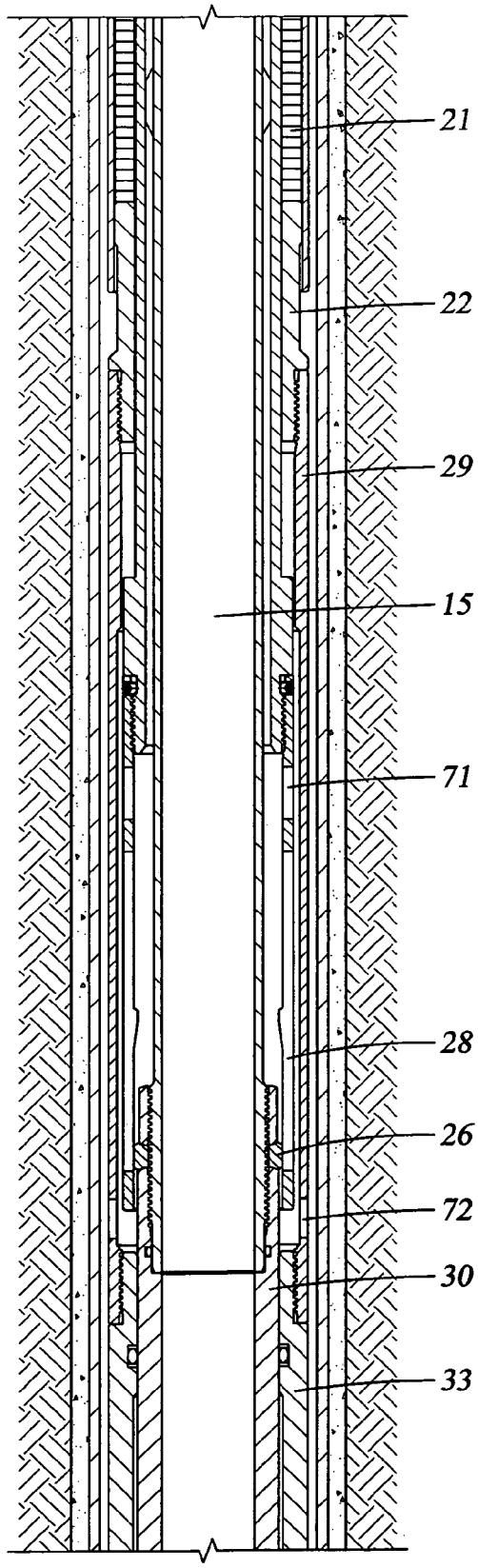
Figure 7D:
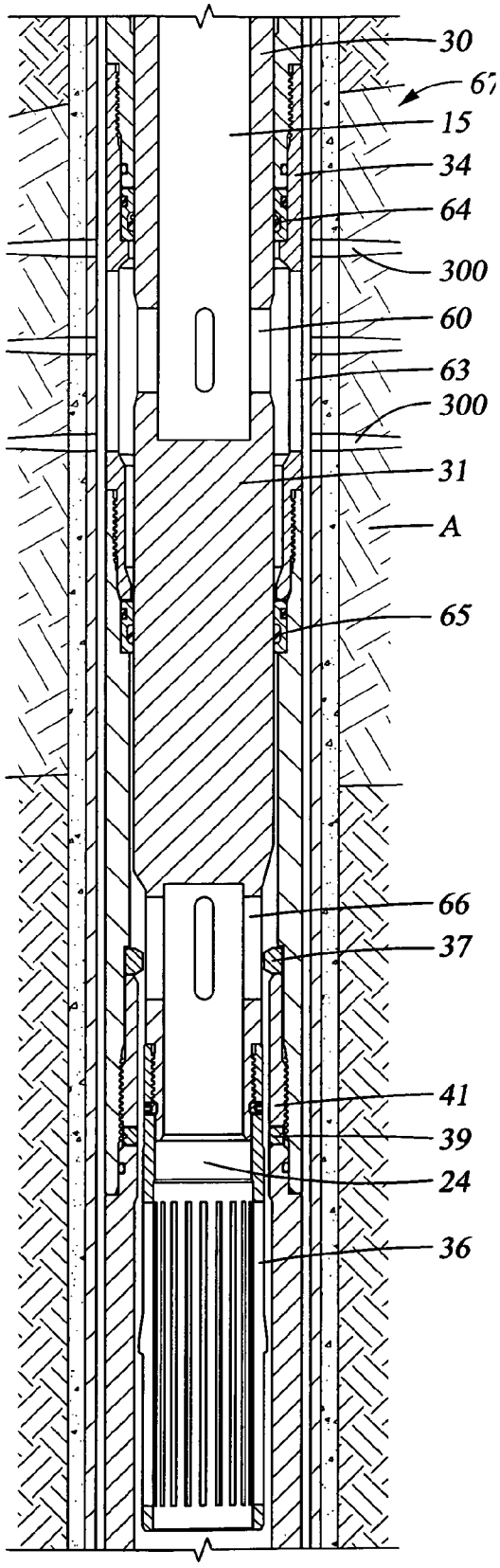

Next, valve 67 will be fully opened and the fracturing operation performed. FIGS. 7A through 7F show the tool 200 with the valve 67 fully open as depicted in FIG. 7D, as the valve 67 would be during fracturing. To fully open the valve 67 by completely aligning the inner valving ports 60 and the outer valving ports 63, additional set down weight is applied. The approximate amount of weight equals the amount of force required to cause the upper collet ring 26 to overcome the upper collet 28 as shown in FIG. 7C. This amount of force is applied to the coiled tubing 150. Once the upper collet ring 26 overcomes the upper collet 28, valve 67 is near its fully open position. Slack off continues as the operator monitors the nitrogen pressure within the coiled tubing 150 for a pressure spike that indicates valve 67 is fully open. Once that pressure spike is observed, the operator ceases to slack off. During this slacking off process, the lug assembly 68, the middle tubular system 220 and the outer tubular system 230 of the tool 200 remain stationary while the inner tubular system 210 moves downwardly until extensions 75 on the ported mandrel 30 engage a shoulder 76 on the top sleeve 4 as shown in FIG. 7B.

With the valve 67 fully open, fracturing can take place. During fracturing, the upper set of sealing elements 17 may tend to slip downwardly, causing some loss of sealing capacity and nitrogen pressure. To prevent such slippage from occurring, the Belleville springs 21 are provided to exert an additional force on the upper set of sealing elements 17, thereby holding them in place against the casing 165 as shown in FIG. 7B.

Once fracturing is complete, the tool 200 can be moved to the next production zone or removed from the wellbore 160. Before moving the tool 200, it must be unlocked. Unlike existing downhole cup-style straddle-packers where the nitrogen pressure must be vented or the formation pressure must be bled down until the cups relax, there is no such requirement to unlock the wellbore fluid saver assembly 200. Instead, an open lower bypass flow path 12 via bypass ports 66 in the ported mandrel 30 communicating with outer valving ports 63, and an open upper bypass flow path 69 via the bypass ports 70, 71, 72, provide pressure equalization across the tool 200 while the valve 67 is closed to contain the nitrogen 180 within the tool 200 and coiled tubing 150.

Figure 8A:
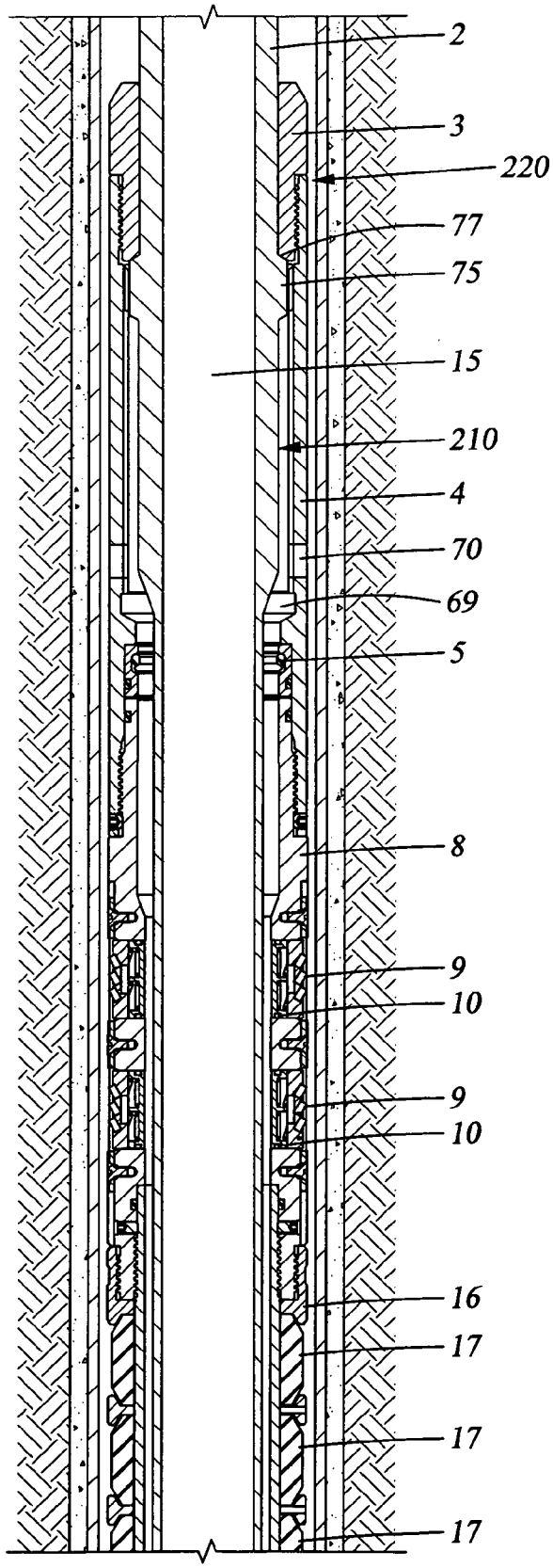
FIGS. 8A through 8F, when viewed sequentially from end-to-end, provide a cross-sectional side view of the wellbore fluid saver assembly after fracturing is complete and the assembly has been picked up to be moved to the next formation zone.
Figure 8B:
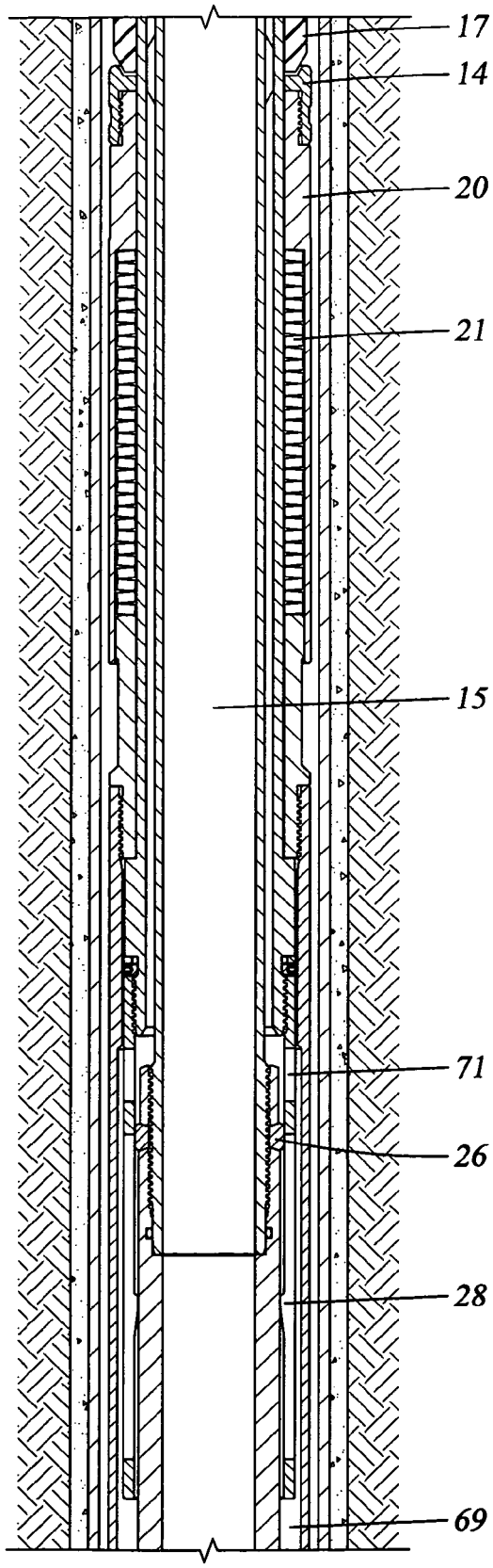
Figure 8C:
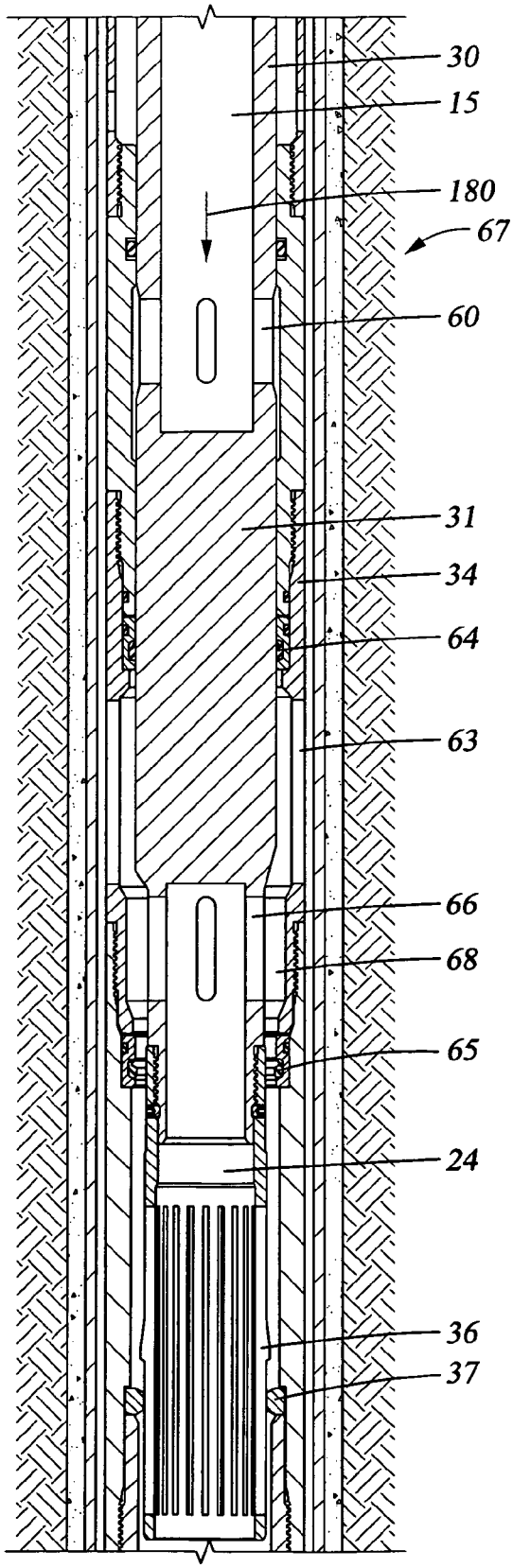
Figure 8D:
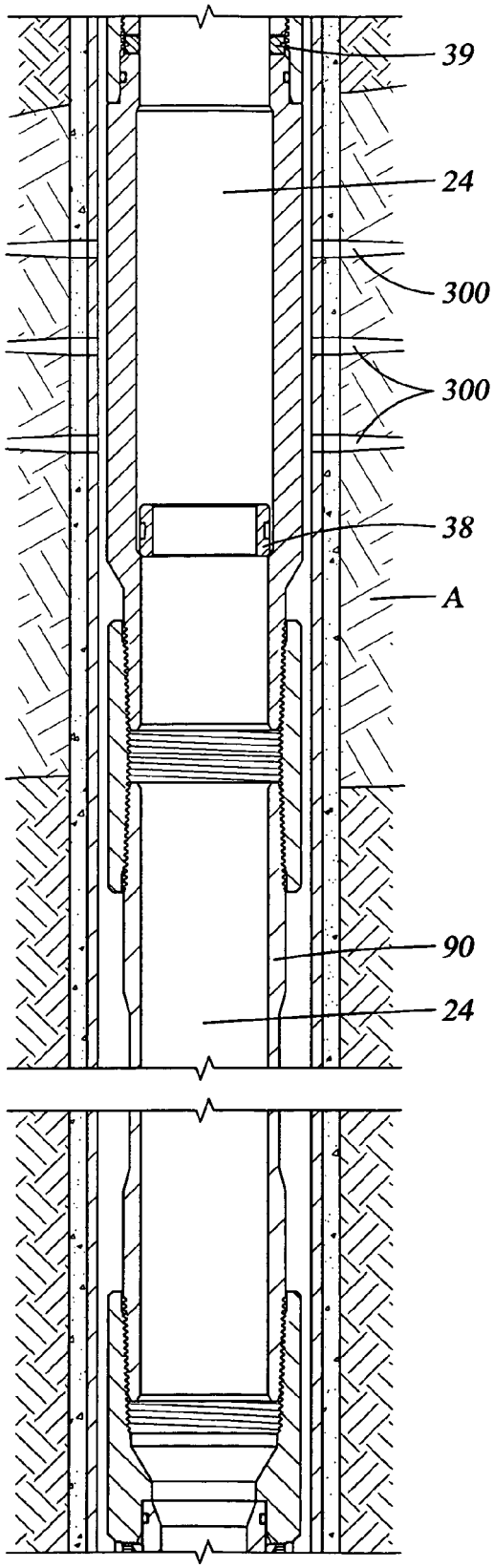
Figure 8E:
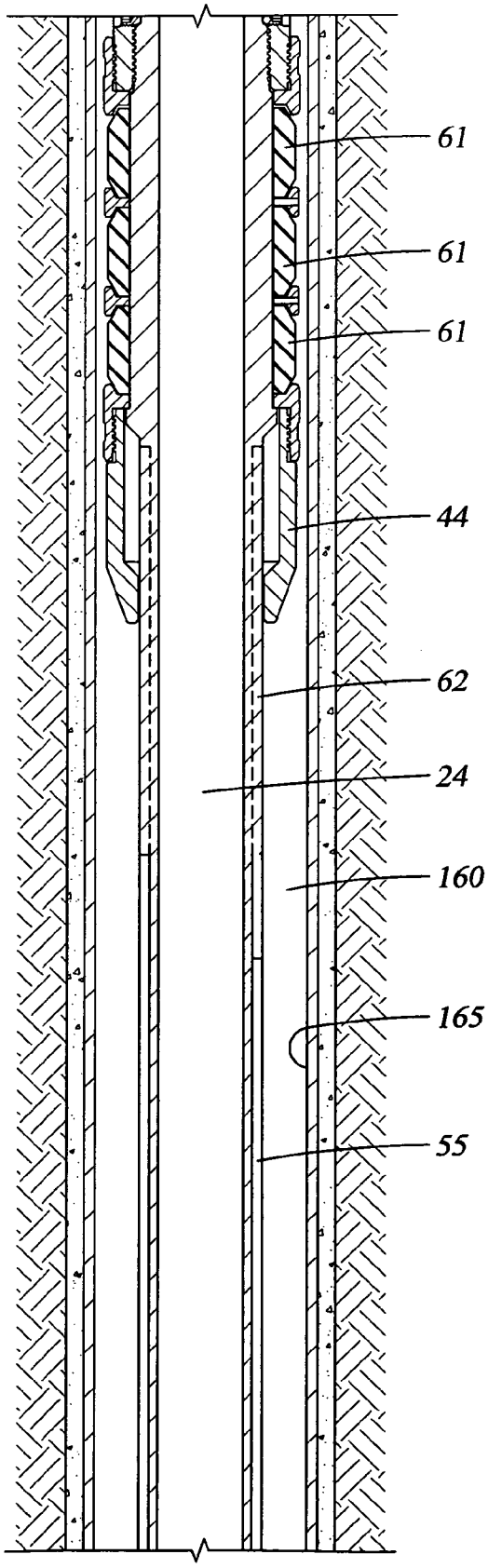
Figure 8F:
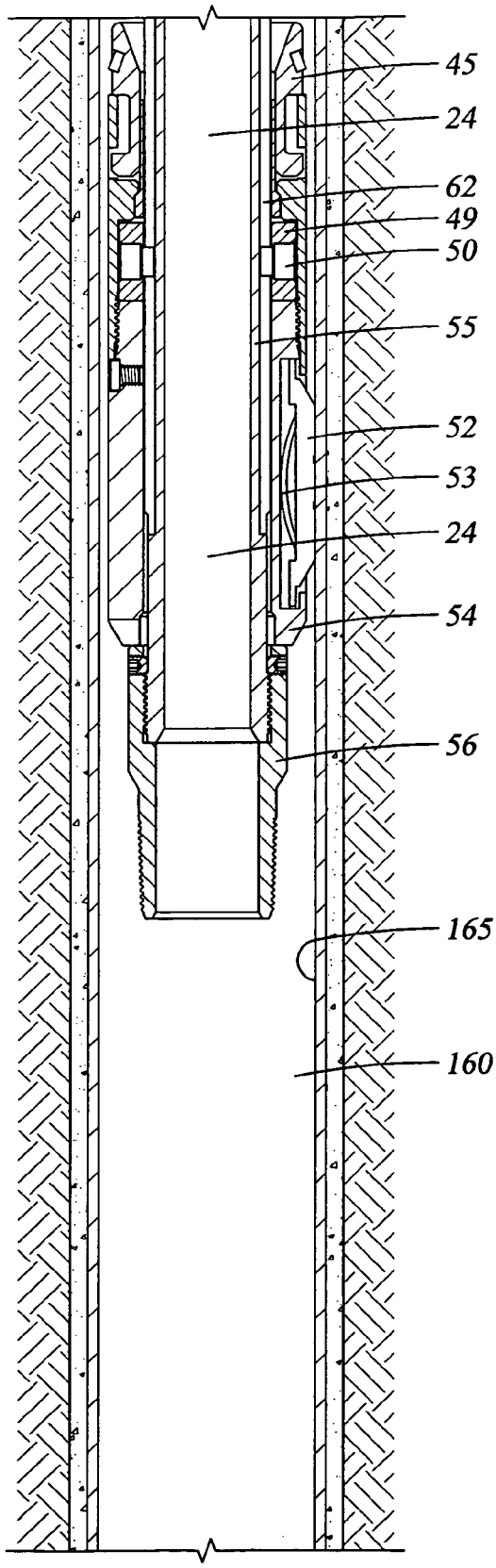

FIGS. 8A through 8F depict the tool 200 when it has been unlocked and it is being moved. To achieve this unlocked configuration, the operator simply picks up on the coiled tubing 150 and the attached tool 200. By picking up the tool 200, the inner tubular system 210 moves up until the extensions 75 on ported mandrel 30 engage a shoulder 77 on the top sleeve cap 3 as shown in FIG. 8A to pull the middle tubular system 220 upwardly. Thus, the load on the upper set of sealing elements 17 is removed, allowing these sealing elements 17 to relax or un-set. Continued tension on the coiled tubing 150 causes the upper collet ring 26 to travel upwards until it passes over the upper collet 28 as shown in FIG. 8B. Due to this relative movement, the inner valving ports 60 and the outer valving ports 63 are no longer aligned, thereby closing valve 67 as shown in FIG. 8C. At the same time, the lower bypass flow path 12 is opened due to the position of the bypass ports 66 in the ported mandrel 30 relative to the lower molded seal 65. Because valve 67 is now closed, high pressure nitrogen 180 is contained within the coiled tubing 150 and the tool 200 and no longer applies a pressure load to the piston buttons 9. Hence, the piston buttons 9 are retracted by the biasing piston spring 10 as shown in FIG. 8A. Continued tension to the coiled tubing 150 causes the lower collet 36 to pass over the lower collet ring 37 as shown in FIG. 8C, similar to what has already transpired with the upper collet 28. The lower set of sealing elements 61 then relax or un-set as shown in FIG. 8E. Referring now to FIG. 9, the continuous J-slot 62 slides along lug 50 as lug 50 shifts from slot 82 to slot 83. J-slot 62 continues to travel upwards relative to lug 50 until lug 50 reaches the end of slot 83 and no further movement of J-slot 62 relative to the lug assembly 68 is permitted. Finally, as shown in FIGS. 8E and 8F, the cone 44 disengages from the slips 45. This relative movement is possible, again, because the drag block 52 continuously engages the casing 165 to provide resistance to the tension load on the coiled tubing 150.

The tool 200 is now ready to be moved. Valve 67 is closed, the upper set of sealing elements 17 and the lower set of sealing elements 61 are unset, the tool 200 is unanchored at both ends, and the bypass flow paths 12, 69 are open. After the tool 200 is moved to the next frac zone, such as production zone "B" shown in FIG. 2, for example, the entire operational sequence is repeated. Specifically, the tool 200 is moved to the ready to set configuration, if not already in this configuration, as shown in FIGS. 5A through 5F. Then the tool 200 is anchored, the upper set of sealing elements 17 and lower set of sealing elements 61 are set, and the valve 67 is partially opened, as depicted in FIGS. 6A through 6F, and so on. In this manner, multiple production zones may be fractured during a single trip downhole. Furthermore, fracturing of the wellbore 160 is completed in a minimal amount of time and with minimal waste of pressurized nitrogen 180.

The foregoing description of the wellbore fluid saver assembly 200 which, upon completion of a wellbore service operation can be moved without venting nitrogen 180 to the surface 170 or waiting for the formation F to bleed down, has been presented for purposes of illustration and description and is not intended to be exhaustive or to limit the invention to the precise form disclosed. Obviously many other modifications and variations of the wellbore fluid saver assembly 200 are possible. In particular, another frac fluid could be used, instead of nitrogen. For example, frac fluids used in acidizing are compatible with this tool. Also, the sealing elements 17, 61 may be replaced with other types of sealing devices. A different number or combination of components may be employed, and other variations are possible.

While a single embodiment of the wellbore fluid saver assembly 200 has been shown and described herein, modifications may be made by one skilled in the art without departing from the spirit and the teachings of the invention. The embodiment described is representative only, and are not intended to be limiting. Many variations, combinations, and modifications of the application disclosed herein are possible and are within the scope of the invention. Accordingly, the scope of protection is not limited by the description set out above, but is defined by the claims which follow, that scope including all equivalents of the subject matter of the claims.

I claim:

1. A method for performing a service operation within a wellbore extending into a formation comprising:

sealing a first length of the wellbore to define a first isolated formation zone;

flowing a pressurized fluid through a tubular string into the first isolated formation zone; and unsealing the first length of the wellbore without venting the pressurized fluid from the tubular string or awaiting depressurization of the first isolated formation zone.

2. The method of claim 1, further comprising:

containing the pressurized fluid within the tubular string.

3. The method of claim 2, further comprising:

moving the tubular string within the wellbore;

sealing a second length of the wellbore to define a second isolated formation zone; and flowing a pressurized fluid through the tubular string into the second isolated formation zone.

4. The method of claim 3, further comprising: performing all steps in a single trip into the wellbore.

5. The method of claim 1, further comprising: equalizing pressure between the sealed first length and an unsealed portion of the wellbore.

6. The method of claim 1 wherein the service operation comprises fracturing a coal bed methane formation.

7. The method of claim 6 wherein the pressurized fluid comprises nitrogen, water, acid, chemicals, or a combination thereof.

8. A method for performing a service operation within a wellbore extending into a formation comprising:

running an assembly comprising a valve into the wellbore on a tubular string;

fixing the assembly within the wellbore to define a first isolated formation zone;

flowing a pressurized fluid through the valve into the first isolated formation zone; and closing the valve to contain the pressurized fluid within the tubular string.

9. The method of claim 8, further comprising: moving the assembly without venting the pressurized fluid from the tubular string or awaiting depressurization of the first isolated formation zone.

10. The method of claim 9, further comprising: equalizing pressure across the assembly before moving the assembly.

11. The method of claim 9, further comprising:

re-fixing the assembly within the wellbore to define a second isolated formation zone;

opening the valve; and flowing the pressurized fluid through the valve into the second isolated formation zone.

12. The method of claim 8 wherein fixing the assembly comprises activating an upper seal and a lower seal within the wellbore to straddle the first isolated formation zone.

13. The method of claim 12 wherein fixing the assembly further comprises: activating an upper anchor and a lower anchor within the wellbore to straddle the first isolated formation zone.

14. The method of claim 13, further comprising bypassing pressure around the upper anchor when running the assembly into the wellbore.

15. A method for performing a service operation within a wellbore extending into a formation comprising:

running an assembly into the wellbore on a tubular string;

engaging a wellbore wall with the assembly;

setting down on the tubular string to activate upper and lower seals of the assembly against the wellbore wall to define an isolated formation zone;

additional setting down on the tubular string to open a valve of the assembly;

flowing a pressurized fluid through the valve into the isolated formation zone; and picking up on the tubular string to close the valve and contain the pressurized fluid within the tubular string.

16. The method of claim 15, further comprising: additional picking up on the tubular string to move the assembly without venting the pressurized fluid from the tubular string or awaiting depressurization of the isolated formation zone.

17. The method of claim 16 wherein the additional picking up opens a bypass flow path.

18. The method of claim 15 wherein the setting down on the tubular string activates a lower anchor of the assembly against the wellbore wall.

19. The method of claim 15 wherein the additional setting down on the tubular string activates an upper anchor of the assembly against the wellbore wall.

20. An assembly connected to a tubular string for performing a service operation in a wellbore, the assembly comprising:

a mandrel with a flowbore in fluid communication with the tubular string;

an upper sealing device;

a lower sealing device;

a selectively operable valve that enables or prevents fluid communication between the flowbore and the wellbore; and a selectively closeable bypass flow path.

21. The assembly of claim 20 wherein the tubular string comprises a coiled tubing.

22. The assembly of claim 20 further comprising a continuous J-slot.

23. The assembly of claim 20 wherein at least one of the sealing devices comprises a plurality of sealing elements.

24. The assembly of claim 20 further comprising drag blocks.

25. The assembly of claim 20 further comprising:

an upper anchor; and a lower anchor.

26. The assembly of claim 25 wherein the upper anchor comprises a plurality of spring-loaded buttons activated by pressure when the bypass flow path is closed.

27. The assembly of claim 25 wherein the lower anchor comprises a slip and cone system.

* * * * *